US010987890B2

(12) United States Patent
Terao et al.

(10) Patent No.: US 10,987,890 B2
(45) Date of Patent: Apr. 27, 2021

(54) BINDING APPARATUS

(71) Applicant: FUJI XEROX CO., LTD., Tokyo (JP)

(72) Inventors: Naoto Terao, Kanagawa (JP); Hiroaki Awano, Kanagawa (JP); Masashi Matsumoto, Kanagawa (JP); Yutaka Nobe, Kanagawa (JP); Takuya Makita, Kanagawa (JP); Yoshiaki Tetsu, Kanagawa (JP); Jun Noguchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 338 days.

(21) Appl. No.: 16/121,294

(22) Filed: Sep. 4, 2018

(65) Prior Publication Data

US 2019/0283358 A1 Sep. 19, 2019

(30) Foreign Application Priority Data

Mar. 16, 2018 (JP) ..... JP2018-048884
Apr. 20, 2018 (JP) ..... JP2018-081475

(51) Int. Cl.
*B31F 5/02* (2006.01)
*B31F 5/00* (2006.01)
*B65H 37/04* (2006.01)

(52) U.S. Cl.
CPC ..... *B31F 5/02* (2013.01); *B31F 5/001* (2013.01); *B65H 37/04* (2013.01); *B31F 2201/00* (2013.01)

(58) Field of Classification Search
CPC ..... B31F 5/02; B31F 5/001; B31F 2201/00; B65H 37/04
See application file for complete search history.

(56) References Cited

U.S. PATENT DOCUMENTS 9,126,794 B2 * 9/2015 Abe ..... B65H 5/068
2012/0148372 A1 * 6/2012 Mori ..... B42B 5/00 412/33
2014/0138896 A1 * 5/2014 Yoshida ..... B31F 5/02 270/58.11
2014/0339754 A1 * 11/2014 Abe ..... B65H 39/00 270/1.01
2015/0183610 A1 7/2015 Matsuki et al.
(Continued)

FOREIGN PATENT DOCUMENTS

JP 2010-189101 A 9/2010
JP 2015-009966 A 1/2015
(Continued)

*Primary Examiner* — David H Banh
(74) *Attorney, Agent, or Firm* — Oliff PLC

(57) ABSTRACT

A binding apparatus includes: a first toothed part including teeth arranged in one direction; and a second toothed part that includes teeth arranged in the one direction and is configured to mesh with the first toothed part and to press a bundle of sheets, wherein at least one first groove is formed between adjacent teeth of the first toothed part, the first groove has cross-sectional areas at central and end portions in a direction orthogonal to the one direction and a direction in which the first and second toothed parts mesh with each other, the one direction and the orthogonal direction are normal to the cross-sectional areas, and the cross-sectional area at the end portion is larger than the cross-sectional area at the central portion.

7 Claims, 28 Drawing Sheets

(56) References Cited

U.S. PATENT DOCUMENTS

| | | | | |
|---|---|---|---|---|
| 2015/0239587 | A1* | 8/2015 | Abe | G03G 15/6541 100/7 |
| 2016/0107409 | A1* | 4/2016 | Kubo | B42B 4/00 412/33 |
| 2017/0282482 | A1* | 10/2017 | Awano | B42C 1/12 |
| 2017/0282483 | A1* | 10/2017 | Makita | B31F 1/07 |
| 2017/0283206 | A1* | 10/2017 | Makita | G11B 7/24024 |

FOREIGN PATENT DOCUMENTS

| | | | | |
|---|---|---|---|---|
| JP | 2015-040087 | A | 3/2015 | |
| JP | 2015-124084 | A | 7/2015 | |
| JP | 2017-132640 | A | 8/2017 | |
| JP | 2017213787 | A * | 12/2017 | B65H 37/04 |

* cited by examiner

BINDING APPARATUS

CROSS-REFERENCE TO RELATED APPLICATIONS

This application is based on and claims priority under 35 USC 119 from Japanese Patent Application No. 2018-081475 filed Apr. 20, 2018 and Japanese Patent Application No. 2018-048884 filed Mar. 16, 2018.

BACKGROUND

(i) Technical Field

The present disclosure relates to a binding apparatus.

(ii) Related Art

JP-A-2010-189101 discloses a sheet binding apparatus which binds a bundle of sheets including multiple sheets by forming concave-convex portions on the bundle of sheets in a thickness direction, the sheet binding apparatus including a pair of toothed members which is provided to be movable in the thickness direction of the bundle of sheets and form the concave-convex portions on the bundle of sheets in the thickness direction by nipping the bundle of sheets, and a pressing force imparting part which imparts pressing force to the pair of toothed members to bind the bundle of sheets on which the concave-convex portions are formed, in which the pressing force imparting part increases the pressing force, which is to be imparted to the pair of toothed members, as a thickness of the bundle of sheets to be bound is increased.

JP-A-2015-124084 discloses a sheet binding processing device including a processing tray which accumulates sheets, a sheet positioning part which positions the sheets disposed on the processing tray at a predetermined binding position, first and second binding units which are disposed to be movable between a binding position set on the sheets positioned on the processing tray and a standby position retracted out of the sheets, a drive unit which moves the first and second binding units to the binding position, and a controller which controls the drive unit, in which when one of the first and second binding units is moved to the binding position, the controller retracts the other of the first and second binding units from the binding position.

JP-A-2017-132640 discloses an image forming apparatus including a transport unit which transports sheets on which images are formed by an image forming unit, a loading unit on which the sheets transported by the transport unit are loaded, a first matching unit which abuts on first sides of the sheets to match the sheets loaded on the loading unit in a width direction, a second matching unit which abuts on second sides of the sheets, which are parallel to the first sides, to match the sheets loaded on the loading unit in the width direction, an abutment unit which abuts on third sides of the sheets, which are parallel to the width direction, to position the sheets loaded on the loading unit, a first binding unit which binds, by using a needle, the sheets which are loaded on the loading unit and positioned by the first and second matching units and the abutment unit, and a second binding unit which binds, without using a needle, the sheets which are loaded on the loading unit and positioned by the first and second matching units and the abutment unit, in which the first binding unit is movable in the width direction and may bind the sheets at different multiple points in the width direction in the vicinity of the third sides on which the abutment unit abuts, the second binding unit is movable in the width direction independently of the first binding unit and may bind the sheets at least one point in the vicinity of the third sides, a movable region of the first binding unit and a movable region of the second binding unit partially overlap each other, the first binding unit is moved from a first standby position to a position for binding the sheets in a case where the sheets on which the images are formed by the image forming unit are set to be bound by the first binding unit, and the second binding unit is moved from a second standby position to the position for binding the sheets in a case where the sheets on which the images are formed by the image forming unit are set to be bound by the second binding unit.

JP-A-2015-040087 discloses a sheet material binding processing device including a binding mechanism which binds a bundle of sheet materials made by bundling multiple sheet materials, a displacement mechanism which moves the binding mechanism between a first standby position at which transport of the sheet materials from an image forming apparatus is not hindered and a second standby position at which the transport of the sheet materials is not hindered and a bundle of sheet materials supplied from a part other than the image forming apparatus is bound, a receiving unit which receives set information indicating a standby position at which the binding mechanism is to be on standby, and a controller which controls the displacement mechanism so that the binding mechanism is on standby at the first standby position when the image forming apparatus does not perform image forming processing in a case where the set information indicates the first standby position, and the binding mechanism is on standby at the second standby position when the image forming apparatus does not perform the image forming processing in a case where the set information indicates the second standby position.

JP-A-2015-009966 discloses an image forming apparatus which has an image forming apparatus main body which forms an image on sheets, and a sheet post-processing device which performs staple processing for binding the sheets on which images are formed by the image forming apparatus main body, the image forming apparatus including a sheet insertion portion into which the sheets are inserted, first and second binding units which are provided to be movable along a path including a typical staple position at which the staple processing is performed on the sheets on which the images are formed by the image forming apparatus main body and a manual staple position at which the staple processing is performed on the sheets inserted into the sheet insertion portion, and a controller which moves one of the first and second binding units to the manual staple position and puts the one binding unit on standby in a case where the staple processing for binding the sheets, on which the images are formed by the image forming apparatus main body, by using the other of the first and second binding units is selected.

In a binding apparatus that binds a bundle of paper sheets by interposing the bundle of paper sheets between a pair of toothed parts and compressing the paper sheets, undesired matter such as paper dust may adhere to the respective toothed parts, which form the pair of toothed parts, and the adhering undesired matter may remain on the respective toothed parts without being discharged from the respective toothed parts.

In a binding apparatus that binds paper sheets by using a binding unit selected from multiple binding units, the selected binding unit may be moved to a binding position at which the paper sheets are bound, so that the time taken to move the selected binding unit can be a standby time until the binding operation starts.

SUMMARY

Aspects of non-limiting embodiments of the present disclosure relate to providing a binding apparatus capable of facilitating the discharge of undesired matter in contrast to a case where the cross-sectional area of a groove formed in a toothed part is constant, a case where the distance between first and second toothed parts is constant, or a case where there is no moving unit for moving undesired matter.

Aspects of non-limiting embodiments of the present disclosure also relate to providing a binding apparatus capable of reducing a standby time required until binding operation starts in contrast to a case where multiple binding units are disposed regardless of which binding unit is preferentially used among the multiple binding units.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a binding apparatus including: a first toothed part including a plurality of teeth arranged in one direction; and a second toothed part that includes a plurality of teeth arranged in the one direction and is configured to mesh with the first toothed part and to press a bundle of sheets, wherein at least one first groove is formed between adjacent teeth of the first toothed part, and the first groove has cross-sectional areas at central and end portions in a direction orthogonal to the one direction and a direction in which the first and second toothed parts mesh with each other, the cross-sectional areas are normal to the one direction and the orthogonal direction, and the cross-sectional area at the end portion is larger than the cross-sectional area at the central portion.

BRIEF DESCRIPTION OF THE DRAWINGS

Exemplary embodiments of the present disclosure will be described in detail based on the following figures, wherein:

FIGS. 5A and 5B illustrate the lower toothed part illustrated in FIG. 4, in which FIG. 5A is a view of the lower toothed part when viewed from arrow A illustrated in FIG. 4, and FIG. 5B is a view of the lower toothed part when viewed from arrow B illustrated in FIG. 4;

DETAILED DESCRIPTION

First Exemplary Embodiment

Figure 1:
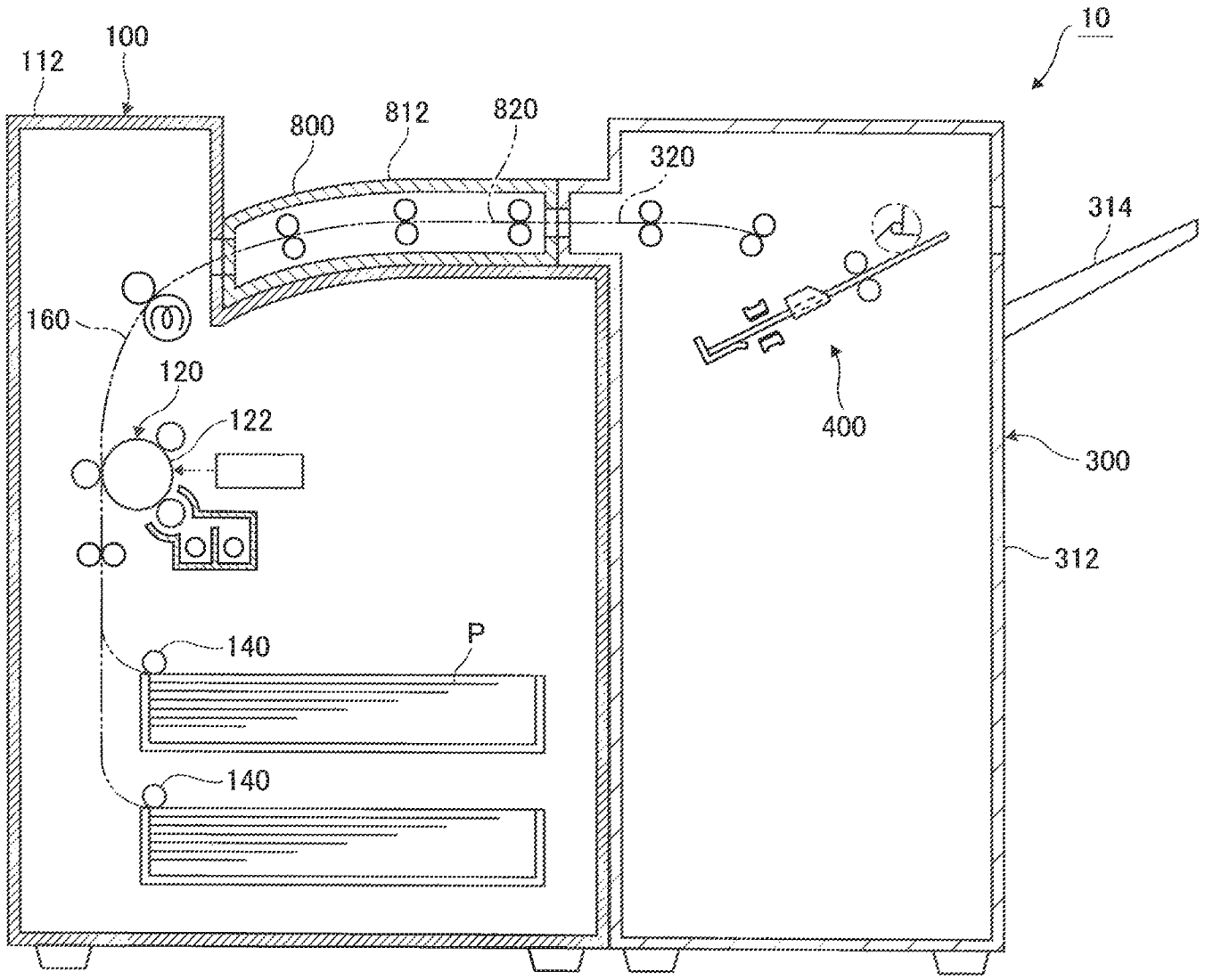
FIG. 1 is a view illustrating a cross section of an image forming apparatus used for an exemplary embodiment of the present disclosure.

Next, an exemplary embodiment of the present disclosure will be described with reference to the drawings. FIG. 1 is a cross-sectional view illustrating an image forming apparatus 10 used for an exemplary embodiment of the present disclosure when viewed from the front side. As illustrated in FIG. 1, the image forming apparatus 10 has an image forming unit 100, a post-processing unit 300, and a transport unit 800.

The image forming unit 100 has an image forming unit main body 112, and an image forming unit 120 and two supply devices 140 are, for example, disposed in the image forming unit main body 112. In addition, a transport path 160 is formed in the image forming unit main body 112.

The image forming unit 120 forms an image on a paper sheet P, as an example of a recording medium, that is, the example is a paper sheet. The image forming unit 120 adopts an electrophotographic process and forms an image on the paper sheet P by forming a toner image by developing, with toner, a latent image formed on a surface of a photoconductor drum 122, transferring the toner image onto the paper sheet P, and fixing the toner image, which is transferred onto the paper sheet P, onto the paper sheet P. For example, other methods such as an inkjet method may be adopted for the image forming unit 120 instead of adopting the electrophotographic process.

The supply device 140 supplies the image forming unit 120 with the paper sheets P, one by one, which are accommodated in a stacked state.

The transport path 160 is used to transport the paper sheet P supplied from the supply device 140 to the image forming unit 120, and the transport path 160 is used to transport the paper sheet P on which the image is formed by the image forming unit 120 so that the paper sheet P is discharged from the image forming unit main body 112.

The post-processing unit 300 has a post-processing unit main body 312, and a binding apparatus 400 is disposed in the post-processing unit main body 312. The binding apparatus 400 is, for example, an apparatus for binding paper sheets such as the paper sheets P on which the image is formed, and the binding apparatus 400 integrates the multiple paper sheets together by binding the multiple paper sheets. A detail of the binding apparatus 400 will be described below.

A discharge unit 314, which discharges the paper sheets P bound by the binding apparatus 400, is mounted on the post-processing unit main body 312.

A transport path 320 is formed in the post-processing unit main body 312. The transport path 320 is used to transport the paper sheets P transported into the post-processing unit main body 312 to the binding apparatus 400.

The transport unit 800 has a transport unit main body 812, and a transport path 820 is formed in the transport unit main body 812. The transport path 820 is used to transport the paper sheets P discharged from the image forming unit main body 112 into the post-processing unit main body 312. A punching device (not illustrated), which punches the paper sheets P, may be disposed in the transport unit 800.

Figure 2:
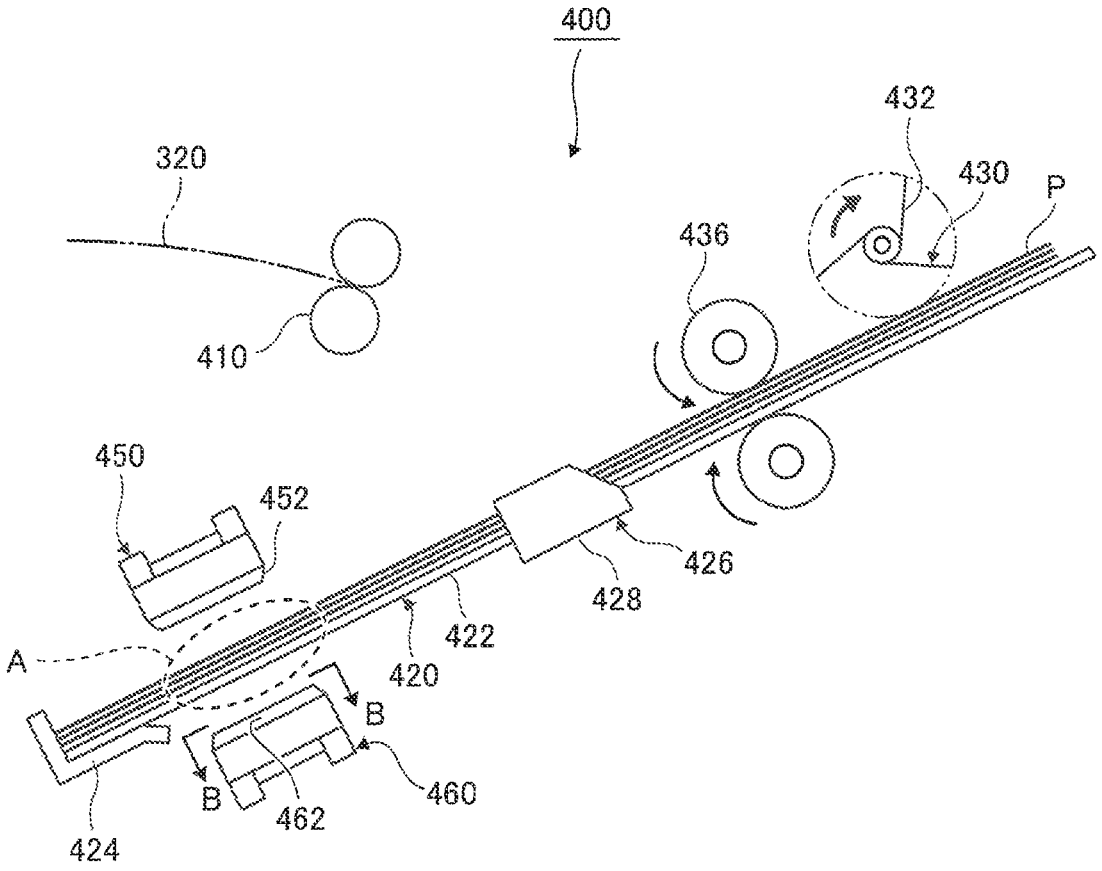
FIG. 2 is a view illustrating a configuration of a binding apparatus of the image forming apparatus illustrated in FIG. 1.

FIG. 2 illustrates the binding apparatus 400. As illustrated in FIG. 2, the binding apparatus 400 has a pair of receiving rolls 410. The pair of receiving rolls 410 is an example of a receiving part and receives the paper sheets P transported from the transport unit 800. In addition, the pair of receiving rolls 410 is disposed along the transport path 320.

The binding apparatus 400 further has a loading unit 420. The loading unit 420 is an example of a loading part, and the multiple paper sheets P, which are received by the receiving rolls 410 and supplied from the receiving rolls 410, are loaded onto the loading unit 420. In addition, the loading unit 420 has a loading plate 422 and an abutting member 424.

The loading plate 422 is inclined so that an end portion of the loading plate 422 close to the abutting member 424 is positioned at a lower side in the direction of gravity from an end portion of the loading plate 422 opposite to the abutting member 424, and the multiple paper sheets P are loaded onto a surface of the loading plate 422 at an upper side in the direction of gravity. In addition, rear end portions of the multiple paper sheets P in a transport direction abut on the abutting member 424. Further, as the rear end portions of the multiple paper sheets P abut on the abutting member 424, the multiple paper sheets P are aligned in the transport direction.

The binding apparatus 400 further has an alignment device 426. The alignment device 426 aligns the multiple paper sheets P in a direction intersecting the transport direction by interposing the multiple paper sheets P between a pair of alignment plates 428 (FIG. 2 illustrates only a front alignment plate 428).

The binding apparatus 400 further has a pushing device 430. The pushing device 430 has, for example, three vanes 432 and rotates in the arrow direction, thereby pushing the paper sheets P so that the rear end portions of the paper sheets P abut on the abutting member 424.

The binding apparatus 400 further has a discharge device 436. The discharge device 436 has a pair of rolls, and the pair of rolls rotates in the arrow direction to discharge the multiple bound paper sheets P to outside the post-processing unit main body 312.

The binding apparatus 400 further has a lower toothed part 460 and an upper toothed part 450. The lower toothed part 460 is an example of a first toothed part and has multiple teeth 462 arranged in parallel in one direction (a direction D1 to be described below). In addition, the lower toothed part 460 is disposed below the upper toothed part 450 so that multiple teeth 462 are directed toward the upper toothed part 450.

The upper toothed part 450 is an example of a second toothed part and has multiple teeth 452 arranged in parallel in the one direction (direction D1), and the upper toothed part 450 meshes with the lower toothed part 460 to press the bundle of paper sheets P. In addition, the upper toothed part 450 is disposed above the lower toothed part 460 so that the teeth 452 are directed toward the lower toothed part 460.

According to the lower toothed part 460 and the upper toothed part 450 which are configured as described above, in a region A surrounded by a dotted line illustrated in FIG. 2, the bundle of paper sheets P is interposed between the lower toothed part 460 and the upper toothed part 450 and the lower toothed part 460 and the upper toothed part 450 press the bundle of paper sheets P. Further, as the lower toothed part 460 and the upper toothed part 450 press the paper sheets P, the paper sheets P, which are adjacent to one another in the bundle of paper sheets P, are attached to one another, such that the bundle of paper sheets P is integrally bound. In addition, a detail of the lower toothed part 460 will be described below.

Figure 3:
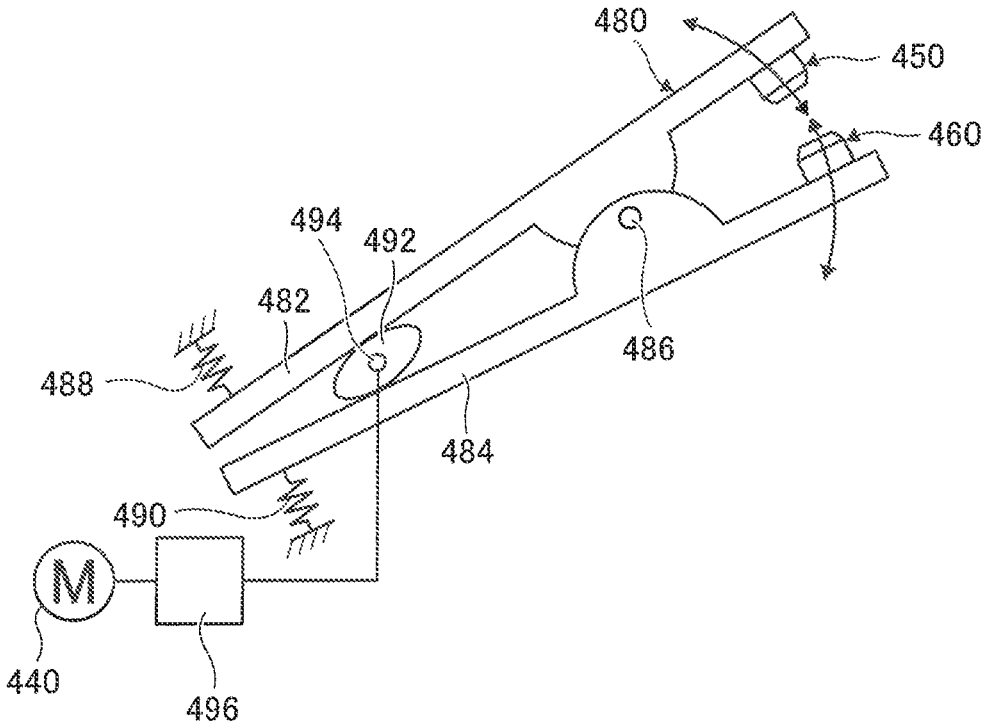
FIG. 3 is a view illustrating operations of an upper toothed part and a lower toothed part of the binding apparatus illustrated in FIG. 2 and illustrating a movement mechanism for moving the upper toothed part and the lower toothed part.

FIG. 3 illustrates operations of the upper toothed part 450 and the lower toothed part 460, and a movement mechanism 480 that moves the upper toothed part 450 and the lower toothed part 460. As illustrated in FIG. 3, the upper toothed part 450 and the lower toothed part 460 are moved, for example, as power from a driving source 440 such as a motor is transmitted to the upper toothed part 450 and the lower toothed part 460 through the movement mechanism 480.

As illustrated in FIG. 3, the movement mechanism 480 has a drive piece 482 and a drive piece 484, the upper toothed part 450 is mounted at one end side of the drive piece 482, and the lower toothed part 460 is mounted at one end side of the drive piece 484. In addition, the drive piece 482 and the drive piece 484 are connected to each other by using a shaft member 486.

The movement mechanism 480 further has a biasing member 488 and a biasing member 490. The biasing member 488 is mounted at the other end side of the drive piece 482, and the biasing member 490 is mounted at the other end side of the drive piece 484. Further, the drive piece 482 is biased by the biasing member 488 so that the drive piece 482 is rotated about the shaft member 486 in a direction in which the upper toothed part 450 is separated from the lower toothed part 460. In addition, the drive piece 484 is biased by the biasing member 490 so that the drive piece 484 is rotated about the shaft member 486 in a direction in which the lower toothed part 460 is separated from the upper toothed part 450.

The movement mechanism 480 further has a cam member 492. The cam member 492 is disposed to be interposed between the other end side of the drive piece 482 and the other end side of the drive piece 484 and supported to be rotated about a shaft member 494. In addition, the driving source 440 is connected to the cam member 492 through a speed reduction mechanism 496, and power is transmitted to the cam member 492 from the driving source 440, such that the cam member 492 is rotated about the shaft member 494.

In the movement mechanism 480 configured as described above, when the cam member 492 is rotated from the state illustrated in FIG. 3, the cam member 492 rotates the drive piece 482 against biasing force of the biasing member 488 in a direction in which the upper toothed part 450 approaches the lower toothed part 460. In addition, when the cam member 492 rotates from the state illustrated in FIG. 3, the cam member 492 rotates the drive piece 484 against biasing force of the biasing member 490 in a direction in which the lower toothed part 460 approaches the upper toothed part 450.

As the drive piece 482 and the drive piece 484 rotate to allow the upper toothed part 450 and the lower toothed part 460 to approach each other, the bundle of paper sheets P is interposed between the upper toothed part 450 and the lower toothed part 460, such that the bundle of paper sheets P is bound.

In the binding apparatus 400, the movement mechanism 480 allows the upper toothed part 450 and the lower toothed part 460 to rotate about the shaft member 486 to approach or separate from each other. In this way, the movement mechanism 480 is an example of a movement mechanism that allows the lower toothed part 460 and the upper toothed part 450 to come into contact with or separate from each other by moving at least one of the lower toothed part 460 and the upper toothed part 450 along an arc.

In the case where the movement mechanism 480 is used, the upper toothed part 450 and the lower toothed part 460 move along the arc, such that the upper toothed part 450 and the lower toothed part 460 are not in contact with or separated from each other in a state in which the upper toothed part 450 and the lower toothed part 460 are maintained in parallel with each other, but the upper toothed part 450 and the lower toothed part 460 are in contact with each other or separated from each other in a state in which the upper toothed part 450 and the lower toothed part 460 have an angle therebetween.

In the binding apparatus 400 configured as described above, since the bundle of paper sheets P is interposed between the upper toothed part 450 and the lower toothed part 460 and then the bundle of paper sheets P is pressed, there is concern that undesired matter such as paper dust adheres to portions of the upper toothed part 450 such as the teeth 452 into which the paper sheets P come into contact, or portions of the lower toothed part 460 such as the teeth 462 into which the paper sheets P come into contact. Further, there is concern that the adhering undesired matter remains on the upper toothed part 450 and the lower toothed part 460 without being discharged from the upper toothed part 450 and the lower toothed part 460.

For this reason, a migration part 200 is provided in the binding apparatus 400, and the migration part 200 allows the undesired matter to move, so that the undesired matter hardly remains on the upper toothed part 450 and the lower toothed part 460. Here, the migration part 200 allows the undesired matter to move from the lower toothed part 460 and the upper toothed part 450 from a side where force applied to the paper sheets P is high to a side where the force applied to the paper sheets P is low, so that the undesired matter between the adjacent teeth 462 and between the adjacent teeth 452 is allowed to move. In addition, the migration part 200 has grooves 464 to be described below and grooves 454 to be described below. In addition, a detail of the migration part 200 will be described below.

FIGS. 4, 5A, 5B, and 6 illustrate a first example of the lower toothed part 460.

Figure 4:
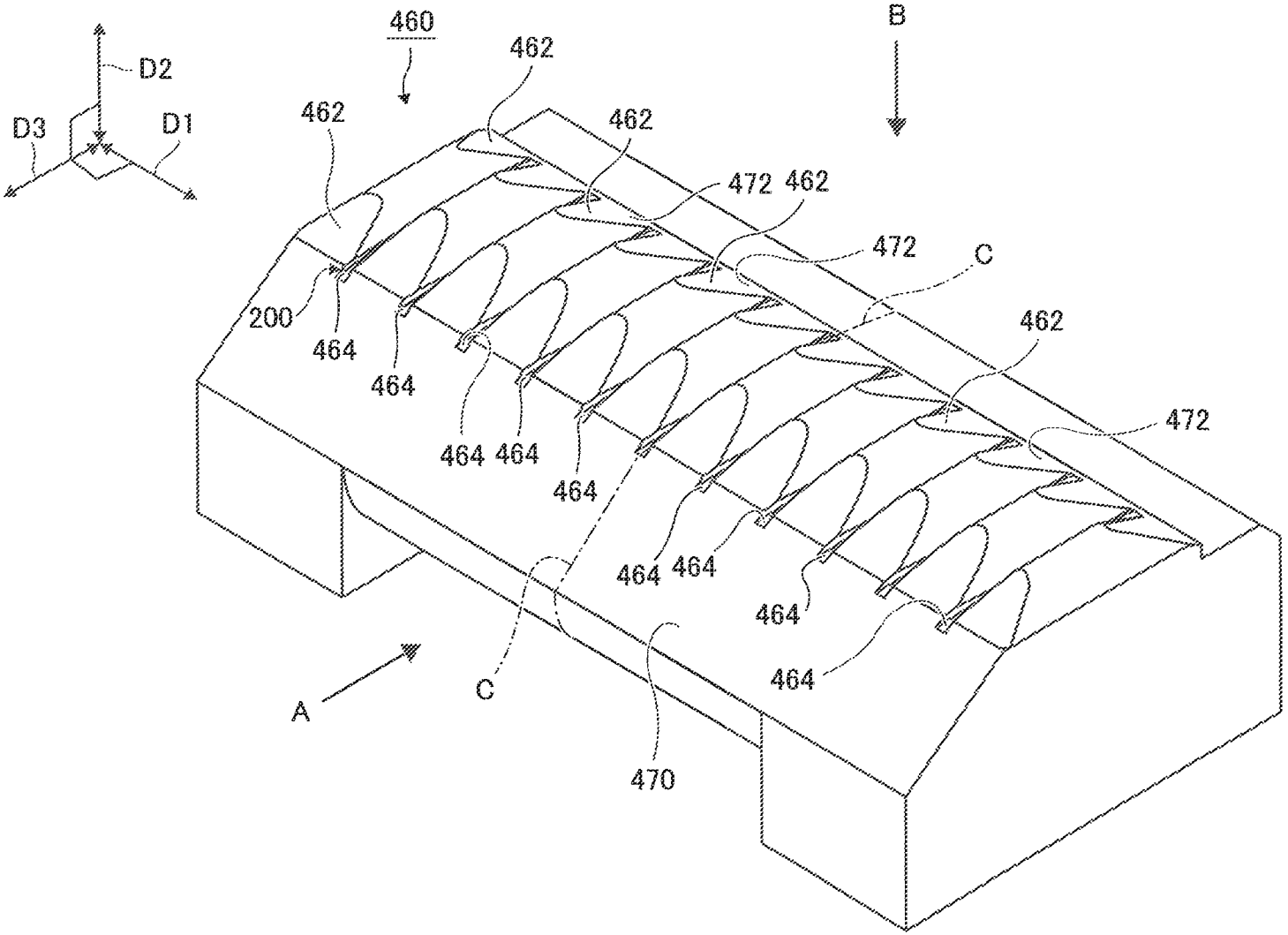
FIG. 4 is a perspective view illustrating a first example of the lower toothed part used for the binding apparatus illustrated in FIG. 2.
Figure 5A:
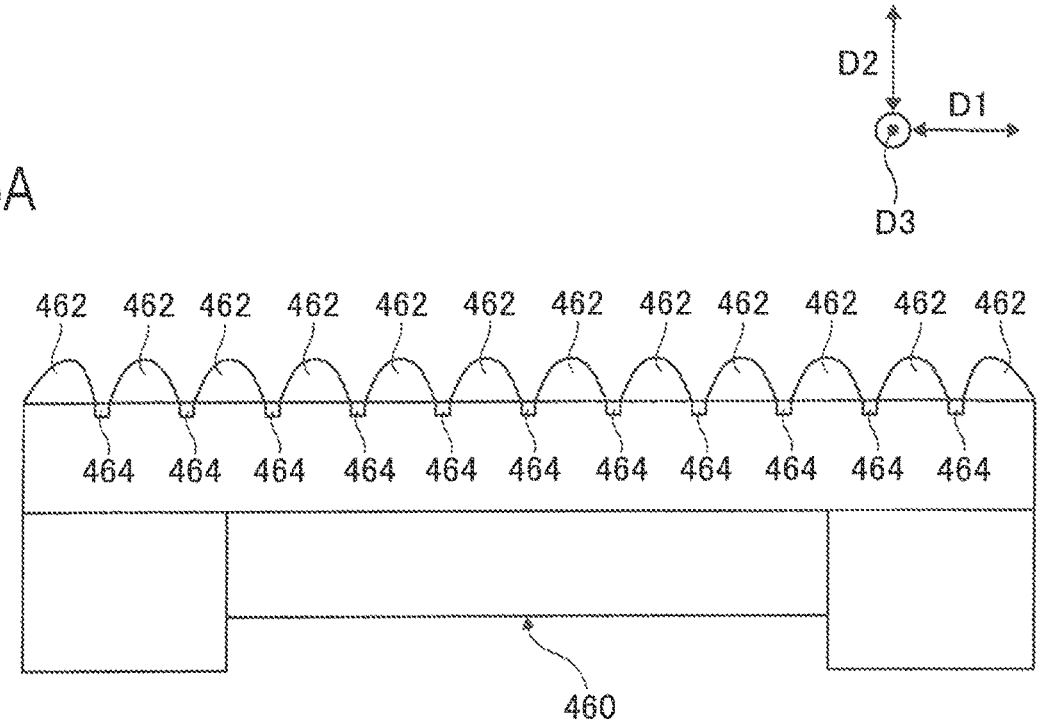
Figure 5B:
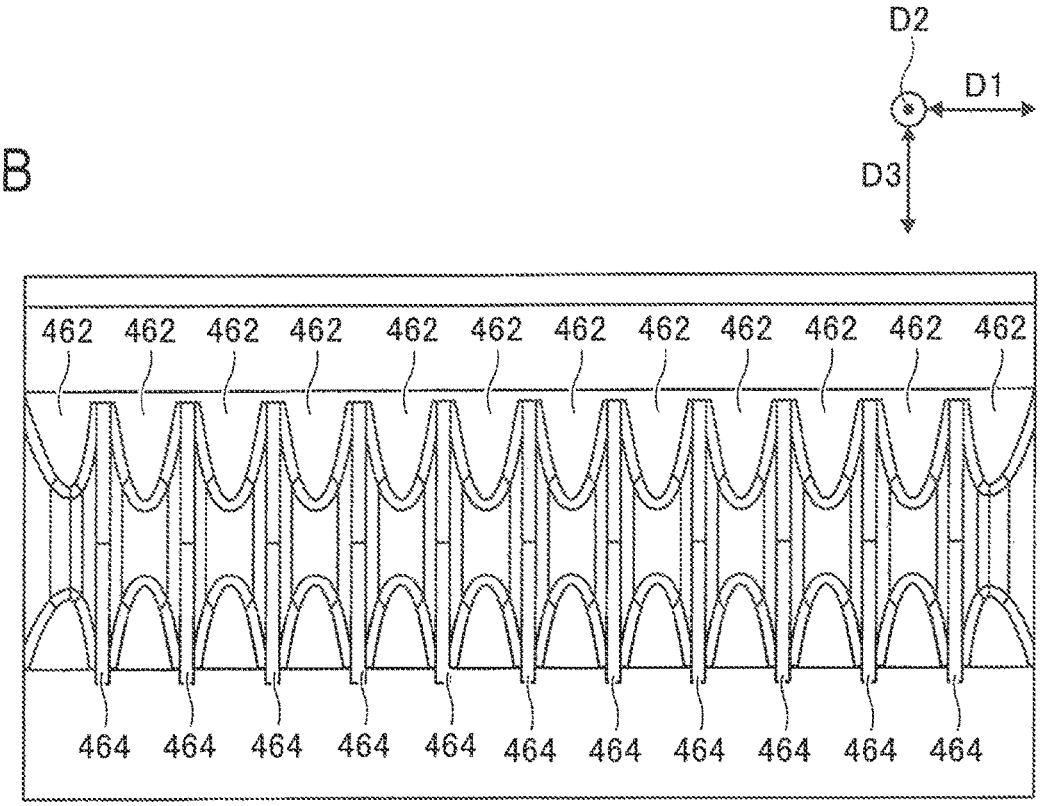
Figure 6:
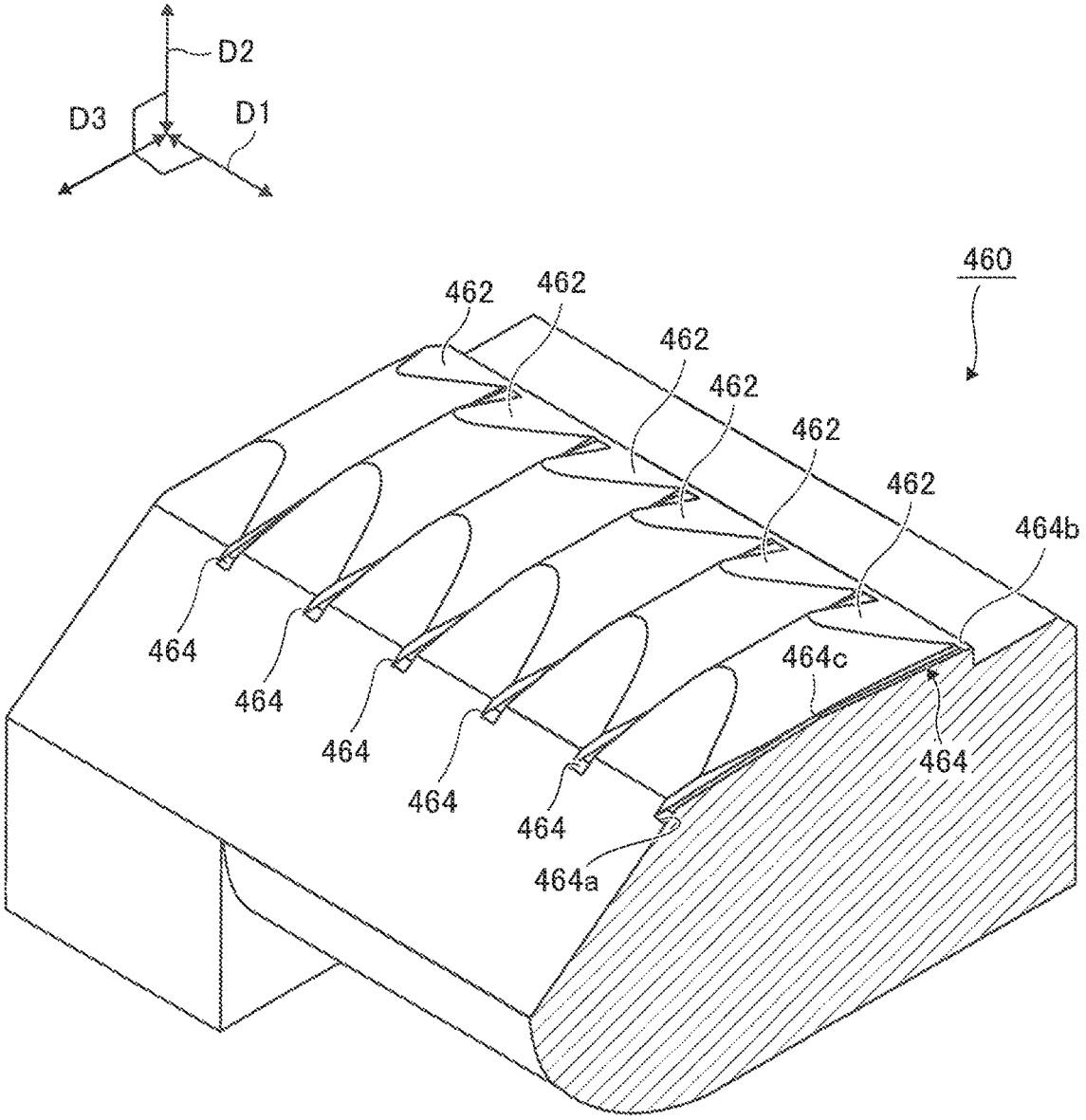
FIG. 6 is a first view illustrating a cross section of the lower toothed part illustrated in FIG. 4 taken along line C in FIG. 4.

A direction D1, a direction D2, and a direction D3, which are used to explain a shape of the lower toothed part 460, will be described before describing the shape of the lower toothed part 460. The direction D1 is an example of one direction disclosed in claims, and as illustrated in FIG. 4, the direction D1 is a direction in which the multiple teeth 462 are arranged when the multiple teeth 462 are disposed. In addition, the direction D2 is an example of a meshing direction disclosed in the claims, and as illustrated in FIG. 4, the direction D2 is a direction in which the upper toothed part 450 and the lower toothed part 460 mesh with each other. In addition, the direction D3 is an example of an orthogonal direction disclosed in the claims, and as illustrated in FIG. 4, the direction D3 is a direction orthogonal to the direction D1 and the direction D2.

Here, the meshing direction refers to a direction in which at least one of the upper toothed part 450 and the lower toothed part 460 is moved at a side immediately adjacent to the position at which the upper toothed part 450 and the lower toothed part 460 come into contact with or separate from each other. As described above, the upper toothed part 450 and the lower toothed part 460 move along the arc, but the movement direction of the upper toothed part 450 and the lower toothed part 460 at the side immediately adjacent to the position at which the upper toothed part 450 and the lower toothed part 460 come into contact with or separate from each other may be considered as a straight movement.

As illustrated in FIGS. 4, 5A, 5B, and 6, the first example of the lower toothed part 460 has the multiple teeth 462, and in this exemplary embodiment, the number of the teeth 462 is 12.

The grooves 464 are formed in the lower toothed part 460. The groove 464 is an example of a first groove and formed between the adjacent teeth 462 among the multiple teeth 462 of the lower toothed part 460. Here, the grooves 464 constitute a part of the migration part 200.

Here, the portions of the lower toothed part 460, which press the bundle of paper sheets P, are the teeth 462 of the lower toothed part 460, but the grooves 464 of the lower toothed part 460 are not the portions that press the bundle of paper sheets P. In this way, the grooves 464 are formed at portions of the lower toothed part 460 other than the portions that press the bundle of paper sheets P.

A guiding surface 470 and guiding surfaces 472 are formed on the lower toothed part 460. The guiding surface 470 and the guiding surface 472 are inclined to guide movement of the undesired matter, which is discharged from the respective grooves 464, downward in the direction of gravity.

Figure 7:
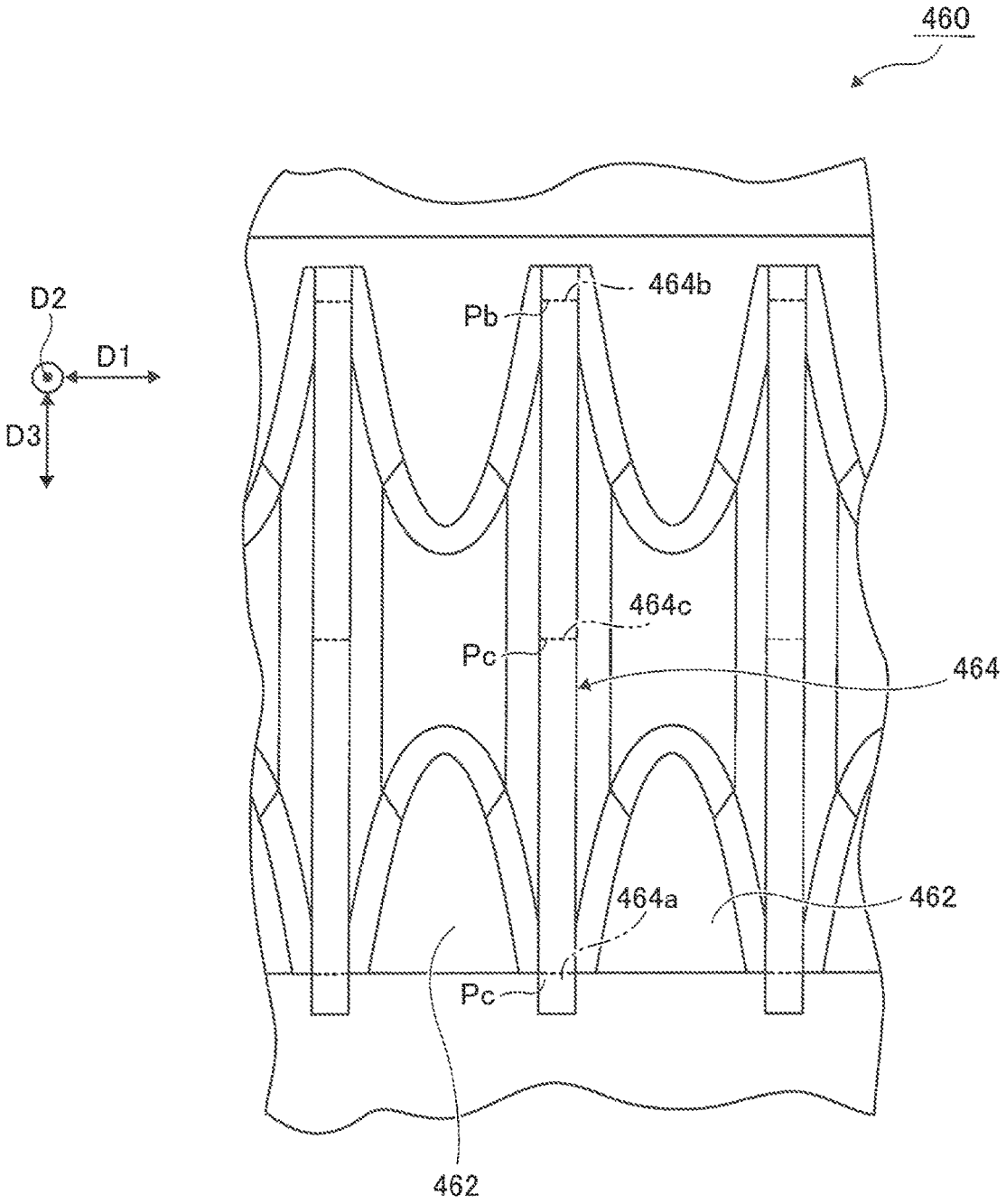
FIG. 7 is an enlarged view illustrating a part of the lower toothed part illustrated in FIG. 4.
Figure 8:
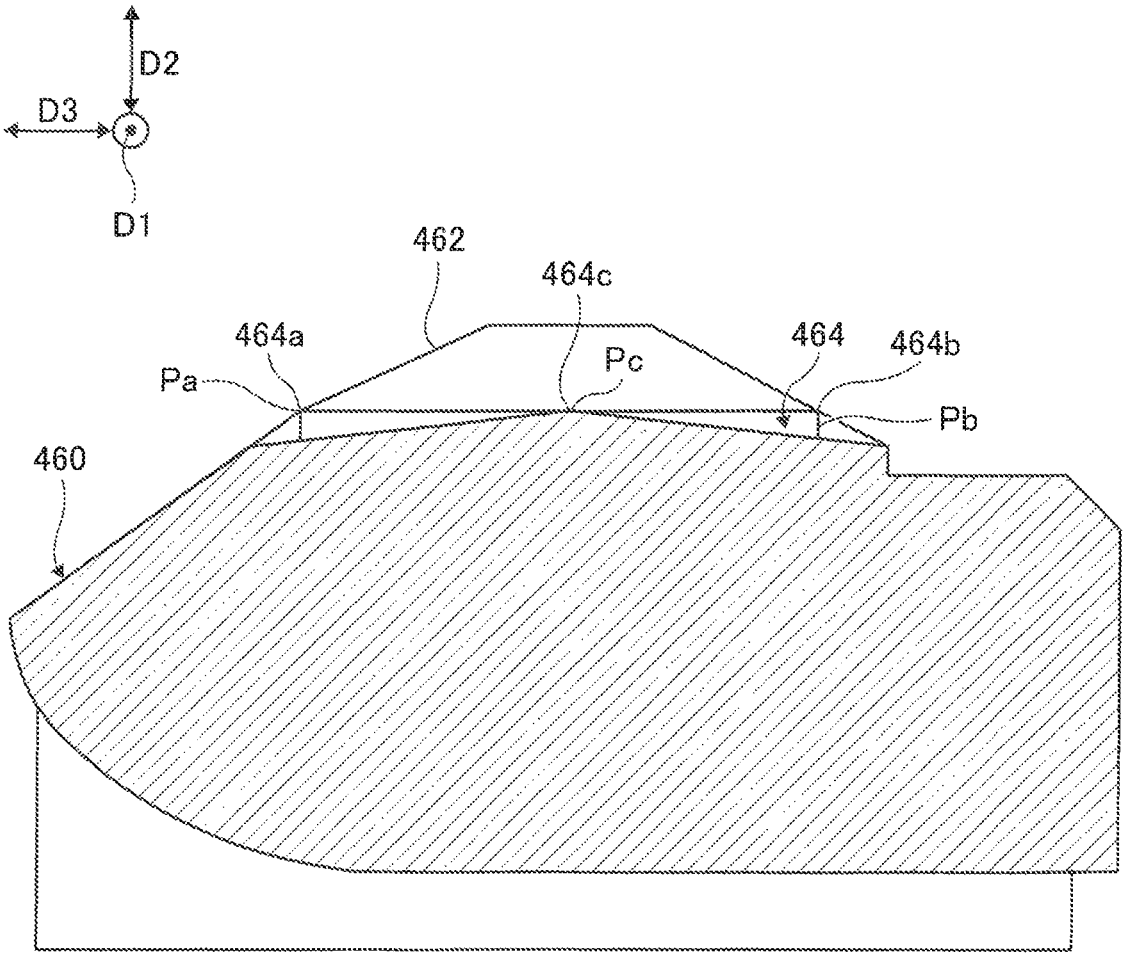
FIG. 8 is a second view illustrating a cross section of the lower toothed part illustrated in FIG. 4 taken along line C in FIG. 4.

FIG. 7 is an enlarged view illustrating a part of the lower toothed part 460, and FIG. 8 is a view illustrating a cross section of the lower toothed part 460. As illustrated in FIGS. 7 and 8, one end portion of the groove 464 in the direction D3 is referred to as one end portion 464*a*, the other end portion of the groove 464 in the direction D3 is referred to as the other end portion 464*b*, and a central portion of the groove 464 in the direction D3 is referred to as a central portion 464*c*. Further, an area of a cross section Pa of the groove 464 at the one end portion 464*a*, which is normal to the direction D1, is referred to as an area Sa, an area of a cross section Pb of the groove 464 at the other end portion 464*b*, which is normal to the direction D1, is referred to as an area Sb, and an area of a cross section Pc of the groove 464 at the central portion 464*c*, which is normal to the direction D1, is referred to as an area Sc.

Here, when comparing the area Sa and the area Sc, the area Sa becomes larger than the area Sc. In addition, when comparing the area Sb and the area Sc, the area Sb becomes larger than the area Sc. That is, in the lower toothed part 460, a cross-sectional area of a surface of the groove 464, which is normal to the direction D1, becomes larger at the end portions than at the central portion in the direction D1.

As illustrated in FIG. 7, widths of the cross section Pa, the cross section Pb, and the cross section Pc in the direction D1 are constant in the first example of the lower toothed part 460, but as illustrated in FIG. 8, regarding widths (heights) of the cross section Pa, the cross section Pb, and the cross section Pc in the direction D2, the width (height) of the cross section Pa is wider (higher) than the width (height) of the cross section Pc, and the width (height) of the cross section Pb is wider (higher) than the width (height) of the cross section Pc.

In the groove 464 configured as described above, the undesired matter moves from the central portion 464*c*, which has the larger cross-sectional area normal to the direction D1, to the one end portion 464*a* and the other end portion 464*b* which have the smaller cross-sectional areas normal to the direction D1. That is, the cross-sectional area of the groove 464 normal to the direction D3 is set so that the force for moving the undesired matter to outside the groove 464 is higher than the force for allowing the undesired matter to remain in the groove 464.

Figure 9:
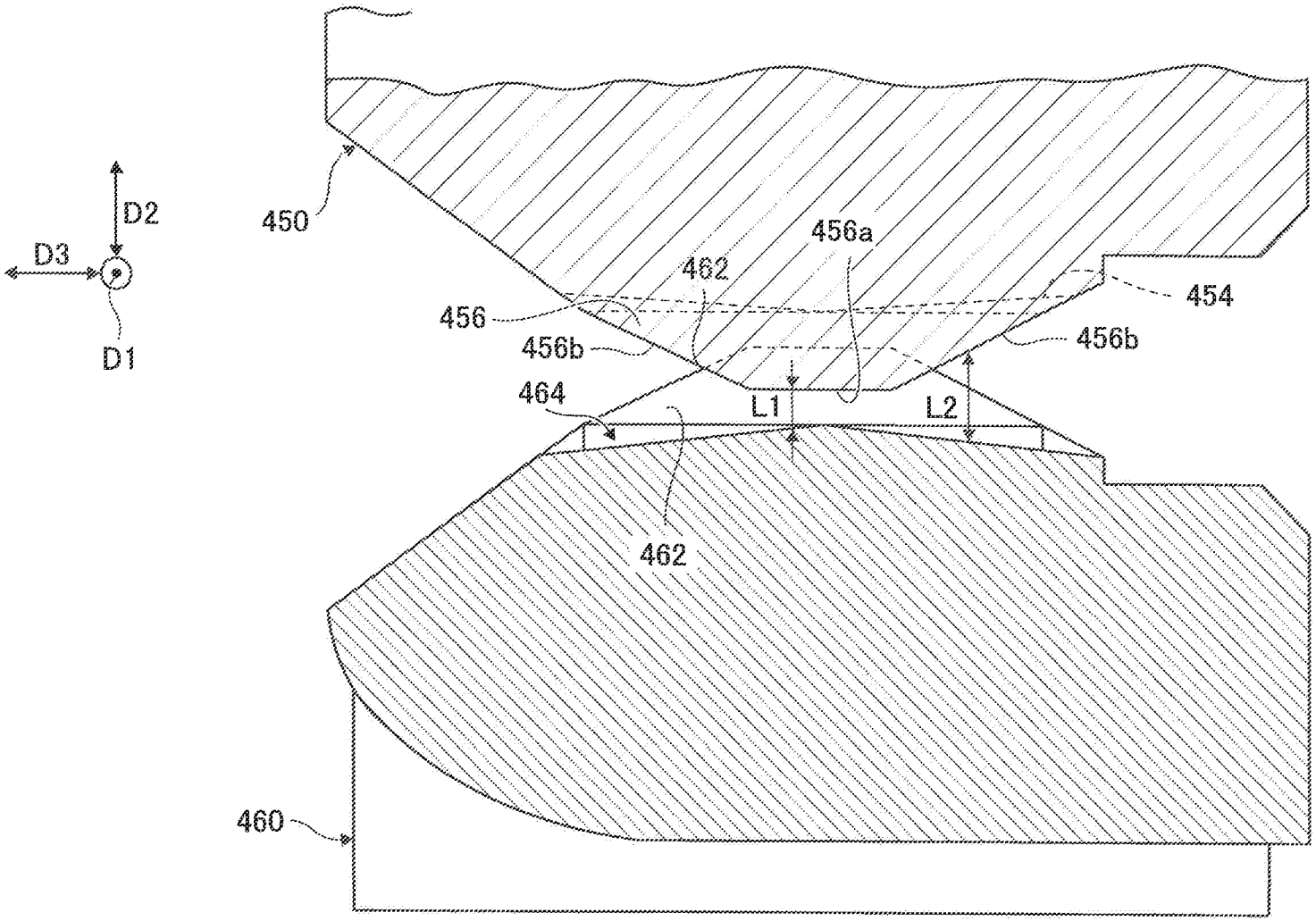
FIG. 9 is a cross-sectional view illustrating a state in which the first example of the lower toothed part and a first example of the upper toothed part mesh with each other.

FIG. 9 illustrates a state immediately before the upper toothed part 450 and the lower toothed part 460 mesh with each other. As illustrated in FIG. 9, the upper toothed part 450 has the teeth 452. In addition, as illustrated in FIG. 9, the grooves 454 are formed in the upper toothed part 450. Here, the grooves 454 constitute a part of the migration part 200.

The groove 454 is an example of a second groove, the grooves 454 are arranged in the direction D1, and the groove 454 is formed between the adjacent two teeth 452. Further, similar to the groove 464, a cross-sectional area of a surface of the groove 454 normal to the direction D1 is larger at the end portions than in the central portion in the direction D1. In addition, as illustrated in FIG. 9, a cross section 456 of the tooth 452 in a direction orthogonal to the direction D1 has a trapezoidal shape.

In the following description, a distance between the upper toothed part 450 and the lower toothed part is referred to as a distance L. In addition, a tip portion of the trapezoidal shape of the cross section 456 is referred to as a tip portion 456*a*, and a slanted portion of the cross-sectional shape of the cross section 456 is referred to as a slanted portion 456*b*. In addition, a distance between the tip portion 456*a* and the lower toothed part 460 is referred to as a distance L1, and a distance between the slanted portion 456*b* and the lower toothed part 460 is referred to as a distance L2.

Here, when comparing the distance L2 and the distance L1, the distance L2 is longer than the distance L1. That is, in the binding apparatus 400, the distance between the lower toothed part 460 and the upper toothed part 450 is longer at a portion of the cross-sectional shape of the cross section 456 between the slanted portion 456*b* and the lower toothed part 460 than at a portion of the trapezoidal shape of the cross section 456 between the tip portion 456*a* and the lower toothed part 460. In addition, for convenience of illustration, FIG. 9 illustrates a state immediately before the tooth 452 is inserted into the groove 464 instead of a state in which the tooth 452 is inserted into the groove 464.

In this way, in the case where the distance between the lower toothed part 460 and the upper toothed part 450 varies, pressure, which is applied to the bundle of paper sheets P from the lower toothed part 460 and the upper toothed part 450, becomes high at a portion where the distance between the lower toothed part 460 and the upper toothed part 450 is short, and the pressure becomes low at a portion where the distance between the lower toothed part 460 and the upper toothed part 450 is long. Further, the undesired matter adhering to the upper toothed part 450 or the lower toothed part 460 moves from a side where the pressure applied to the bundle of paper sheets P is high and the pressure applied to the undesired matter is high to a side where the pressure applied to the bundle of paper sheets P is low and the pressure applied to the undesired matter is low.

For this reason, in the binding apparatus 400, the undesired matter in the grooves 464 is moved from the central portion 464*c* of the groove 464 where the applied pressure is high to the one end portion 464*a* or the other end portion 464*b* where the applied pressure is low, so that the undesired matter is discharged from the interior of the grooves 464.

As illustrated in FIG. 9, the amount of change in distance L is decreased in a direction from a portion between the slanted portion 456*b* of the trapezoidal shape of the cross section 456 and the lower toothed part 460 to a portion between the tip portion 456*a* of the trapezoidal shape of the cross section 456 and the lower toothed part 460. In addition, as illustrated in FIG. 9, the distance L is constant at a portion between the tip portion 456*a* of the trapezoidal shape of the cross section and the lower toothed part 460 even though the position in the direction D3 varies.

Similar to the upper toothed part 450 described above, a cross section of the tooth 462 of the lower toothed part 460 in the direction orthogonal to the direction D1 also has a trapezoidal shape. Further, the distance L is longer at the portion between the tip portion of the tooth 462 and the upper toothed part 450 than at the portion between the tip portion of the cross-sectional shape of the tooth 462 and the upper toothed part 450. Further, similarly to the undesired matter in the grooves 454, the undesired matter in the grooves 464 are moved from the central portion of the groove 454 where the applied pressure is high to the one end side or the other end side where the applied pressure is low, so that the undesired matter is discharged from the grooves 454.

Figure 10:
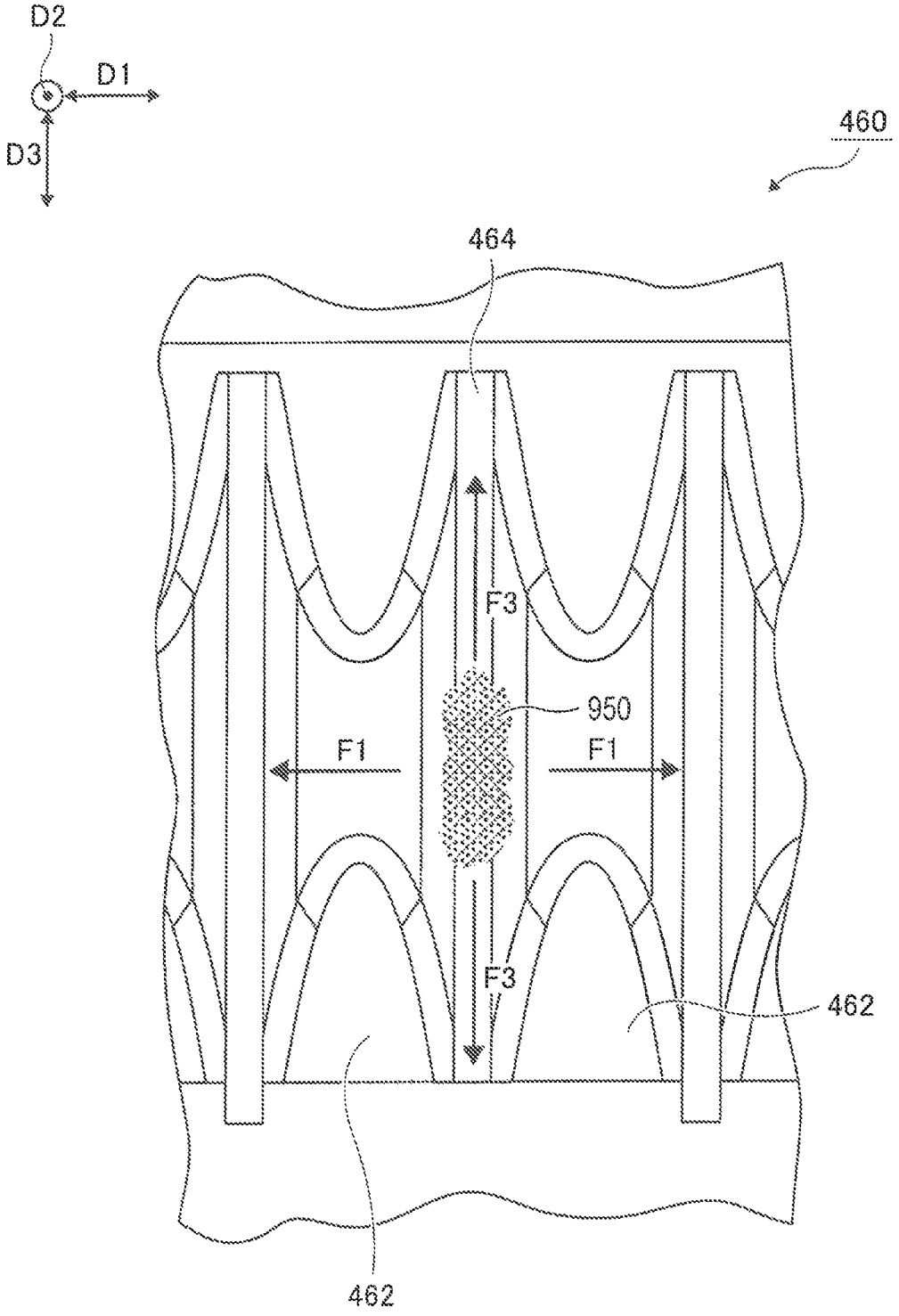
FIG. 10 is a view for explaining force applied to undesired matter adhering to the lower toothed part.

FIG. 10 explains the force applied to the undesired matter adhering to the lower toothed part 460. In the description regarding FIG. 10, the undesired matter is represented by 900. In a case where the undesired matter 950 adheres to the groove 464, a force F1 is applied to the undesired matter 950 in the direction D1, as illustrated in FIG. 10. The reason is that, as described above, the upper toothed part 450 and the lower toothed part 460 are not in contact with or separated from each other in a state in which the upper toothed part 450 and the lower toothed part 460 are maintained in parallel with each other, but the upper toothed part 450 and the lower toothed part 460 are in contact with or separated from each other in a state in which the upper toothed part 450 and the lower toothed part 460 have an angle therebetween.

The force that is applied to the undesired matter 950 in the direction D3 to discharge the undesired matter 950 from the groove 464 is represented by F3. Here, the force F3 has a magnitude that can discharge the undesired matter 950 from the groove 464 even though the force F1 is applied. In other words, the groove 464 is formed to have a cross-sectional area set, for example, so that the force F1, which can discharge the undesired matter 950 from the groove 464 even though the force F3 is applied, is generated.

Figure 11:
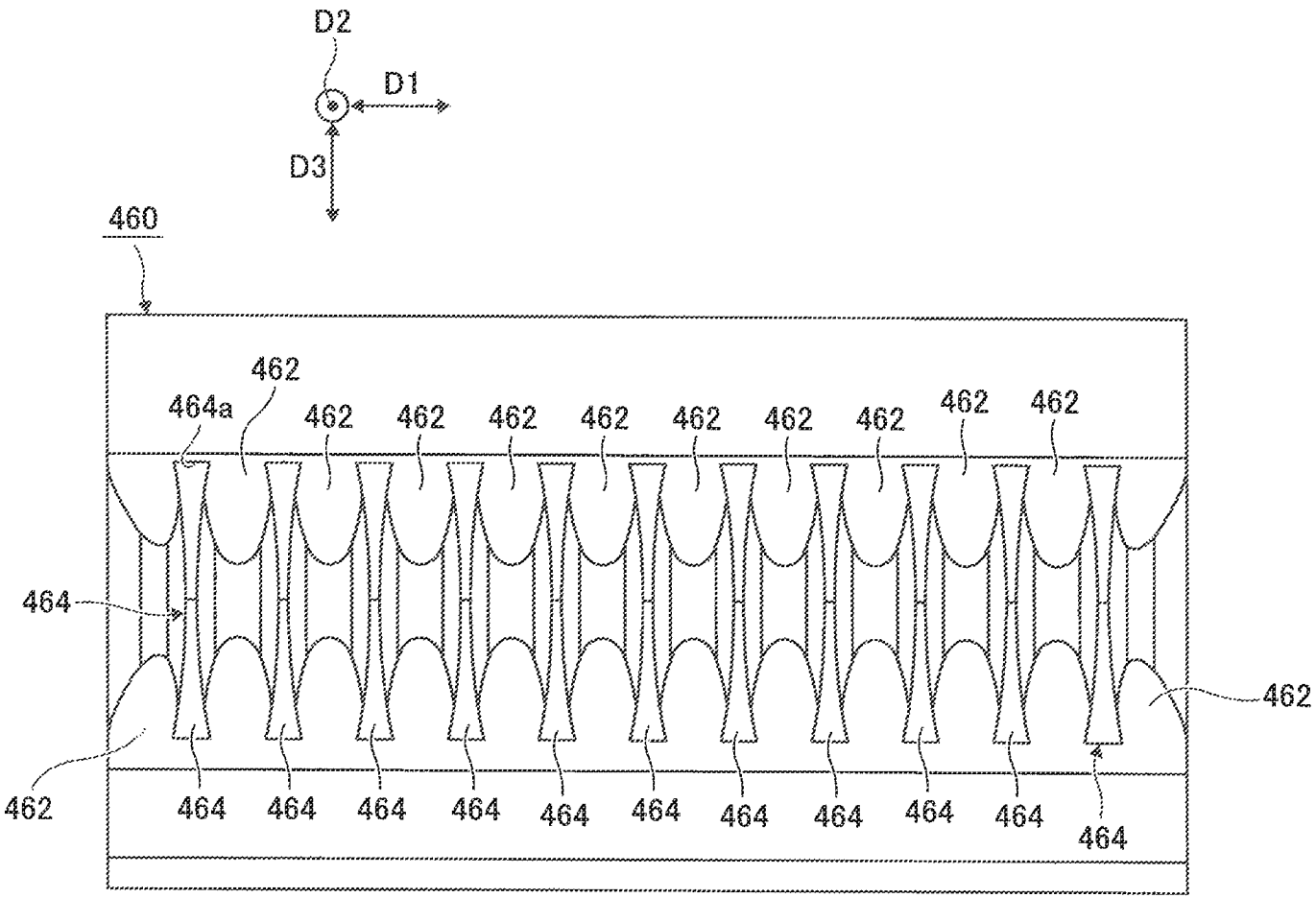
FIG. 11 is a view illustrating a second example of the lower toothed part used for the binding apparatus illustrated in FIG. 2.

FIG. 11 illustrates a second example of the lower toothed part 460 when viewed from plane B-B illustrated in FIG. 2. In the first example of the lower toothed part 460, the cross-sectional area of the surface of the groove 464 normal to the direction D3 becomes larger at the end portions than at the central portion in the direction D3, and the width (height) of the groove 464 in the direction D2 is wider (higher) at its outer side than at its inner side. In the second example, the cross-sectional area of the groove 464 normal to the direction D1 is made larger at the end portions than at the central portion in the direction D3 similarly to the first example, but the width of the groove 464 in the direction D1 is larger at the outer side than at the inner side.

Figure 12:
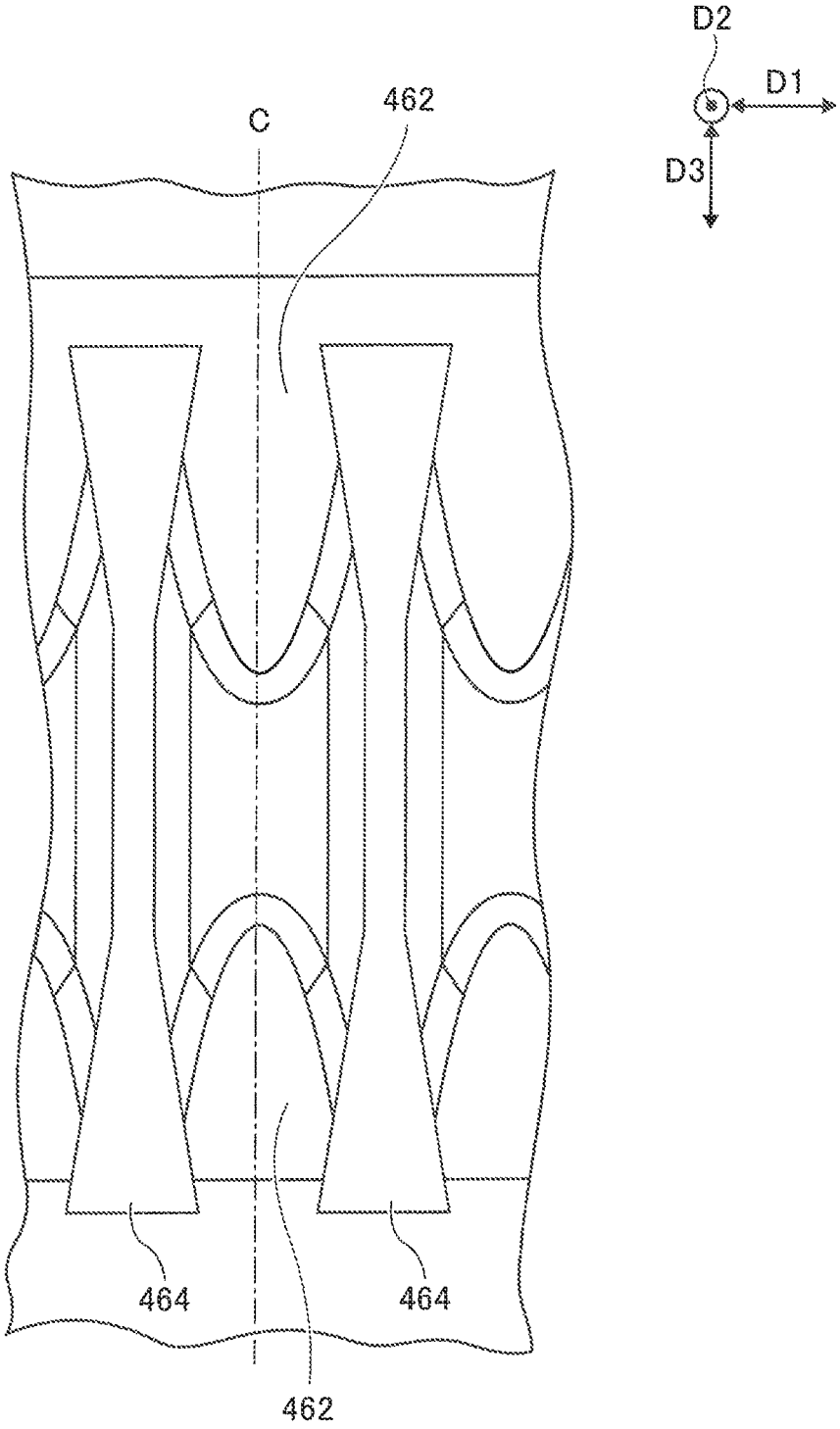
FIG. 12 is an enlarged view illustrating grooves of the second example of the lower toothed part.

FIG. 12 is an enlarged view illustrating the groove 464 of the second example of the lower toothed part 460. As illustrated in FIG. 11, the two grooves 464 with the tooth 462 interposed therebetween have a symmetrical shape with respect to a center c of the tooth 462 in the direction D3. In addition, at least a part of the groove 464 is inclined with respect to the direction D3.

Figure 13:
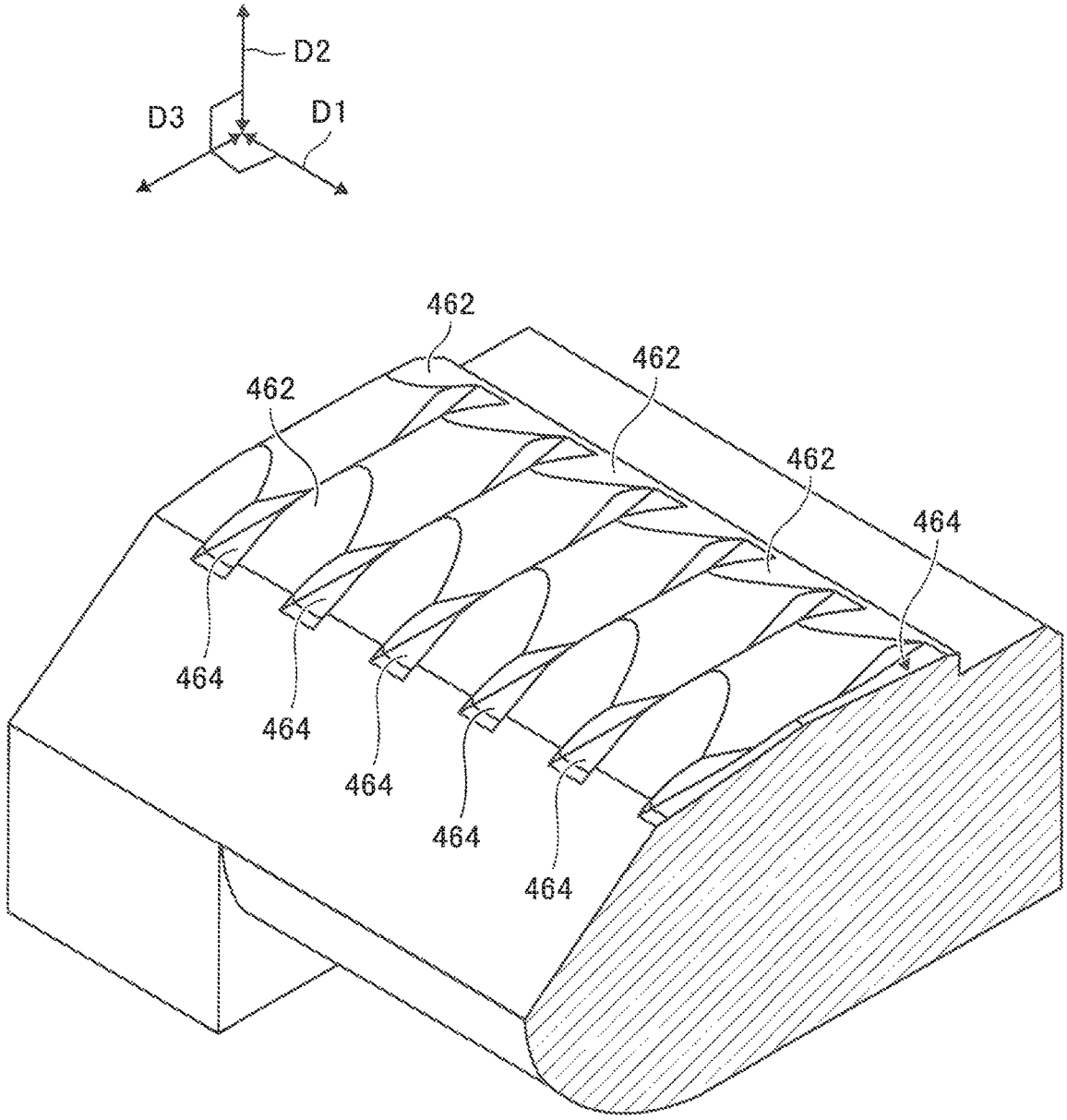
FIG. 13 is a view illustrating a third example of the lower toothed part used for the binding apparatus illustrated in FIG. 2.

FIG. 13 illustrates a third example of the lower toothed part 460. In the third example of the lower toothed part 460, similar to the first example of the lower toothed part 460, the cross-sectional area of the groove 464 normal to the direction D3 is larger at the end portions than at the central portion in the direction D3. In addition, in the third example of the lower toothed part 460, the width (height) of the groove 464 in the direction D2 is larger (higher) at the outer side than at the inner side, and the width in the direction D1 is larger at the outer side than at the inner side.

In the third example of the lower toothed part 460, the amount of change in width of the groove 464 in the direction D1 is larger than the amount of change in width in the direction D2.

Second Exemplary Embodiment

Figure 14:
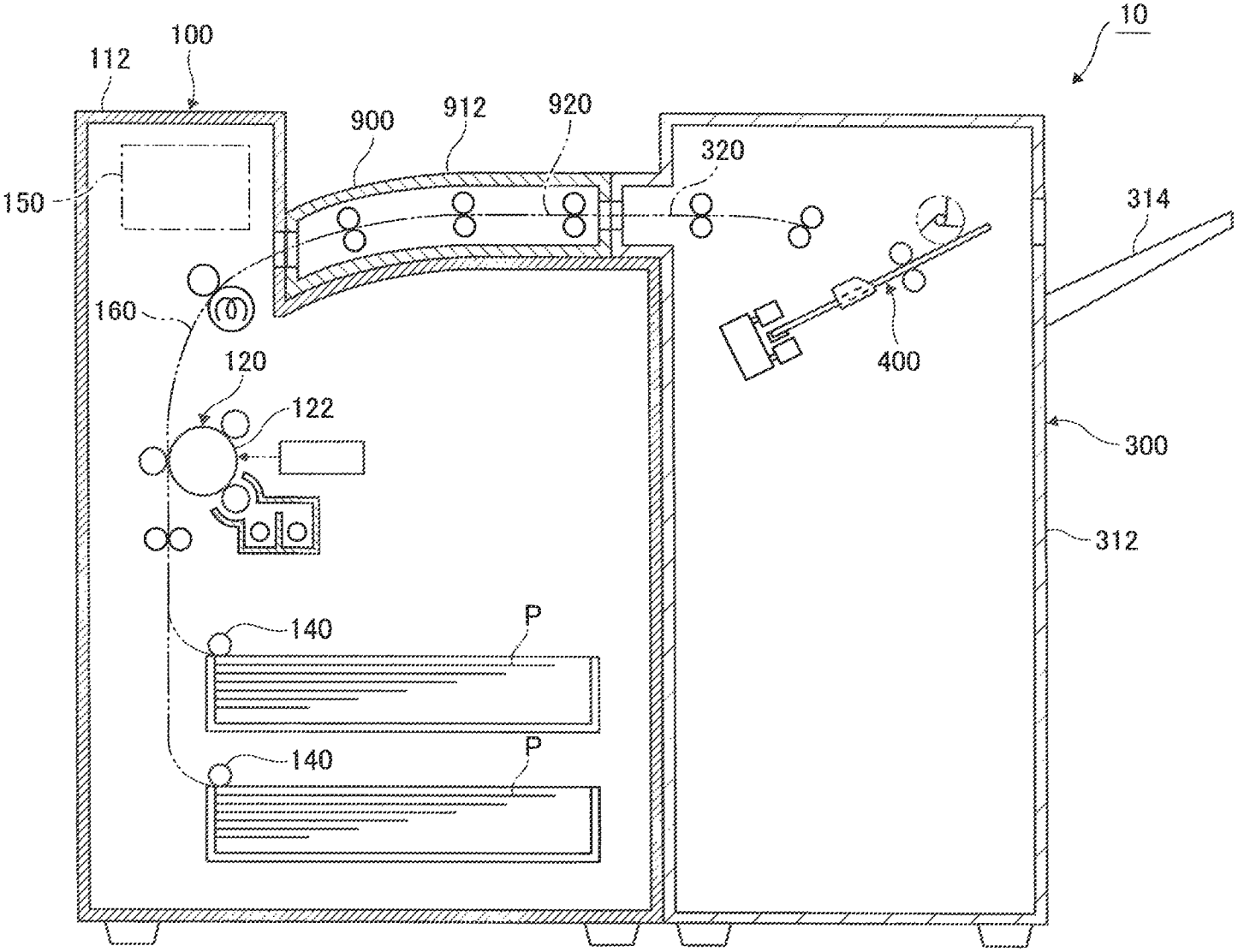
FIG. 14 is a view illustrating a cross section of an image forming apparatus used for another exemplary embodiment of the present disclosure.

Another exemplary embodiment of the present disclosure will be described with reference to the drawings. FIG. 14 is a cross-sectional view illustrating an image forming apparatus 10 used for an exemplary embodiment of the present disclosure when viewed from the front side. As illustrated in FIG. 14, the image forming apparatus 10 has an image forming unit 100, a post-processing unit 300, and a transport unit 900.

The transport unit 900 has a transport unit main body 912, and a transport path 920 is formed in the transport unit main body 912. The transport path 920 transports paper sheets P discharged from an image forming unit main body 112 into a post-processing unit main body 312. A punching device (not illustrated), which punches the paper sheets P, may be disposed in the transport unit 900. The image forming apparatus 10 in the present exemplary embodiment is similar to the image forming apparatus in the first exemplary embodiment except for features to be described below.

The image forming apparatus 10 further has an operation panel 150. The operation panel 150 constitutes a part of a setting unit, and the operation panel 150 is used to perform various types of settings on the image forming apparatus 10. In addition, a screen for various types of operations or a screen for settings (for example, see FIG. 18) is displayed on the operation panel 150. The operation panel 150 is mounted on a front surface of the image forming unit main body 112, for example. In addition, a detail of the operation panel 150 will be described below.

Figure 15:
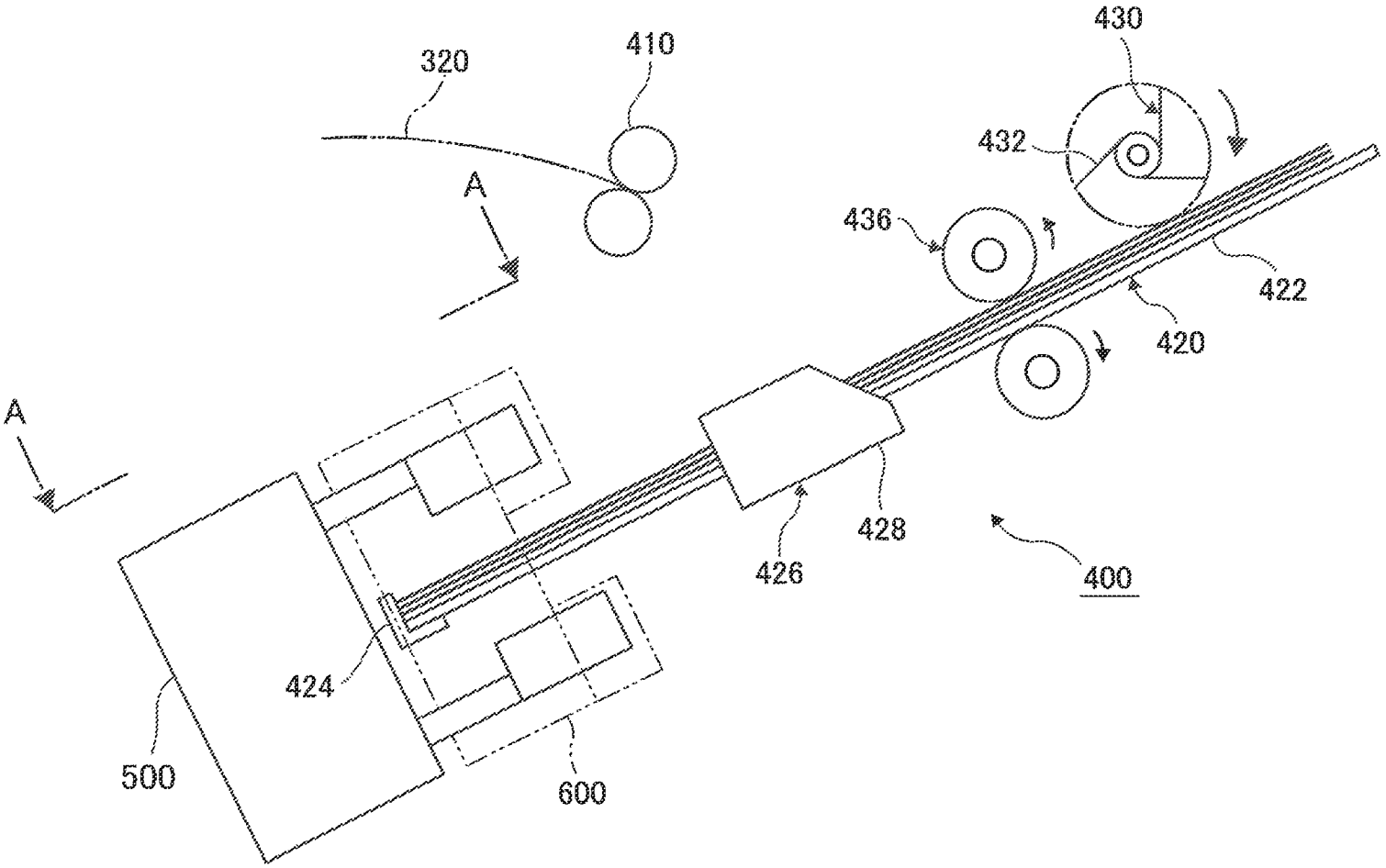
FIG. 15 is a view illustrating a configuration of a binding apparatus of the image forming apparatus illustrated in FIG. 14.

FIG. 15 illustrates a binding apparatus 400. The binding apparatus 400 is similar to that in the first exemplary embodiment. Therefore, different features will be described below.

The binding apparatus 400 further has a pressing type binding unit 500 and a needle type binding unit 600. The pressing type binding unit 500 is an example of a first binding unit and an example of a binding unit that binds the paper sheets P without using a binding member. The needle type binding unit 600 is an example of a second binding unit and an example of a binding unit that binds the paper sheets P by using the binding member. Here, for example, a needle 670 (see FIG. 17) may be used as the binding member. A detail of the pressing type binding unit 500 and a detail of the needle type binding unit 600 will be described below.

Figure 19:
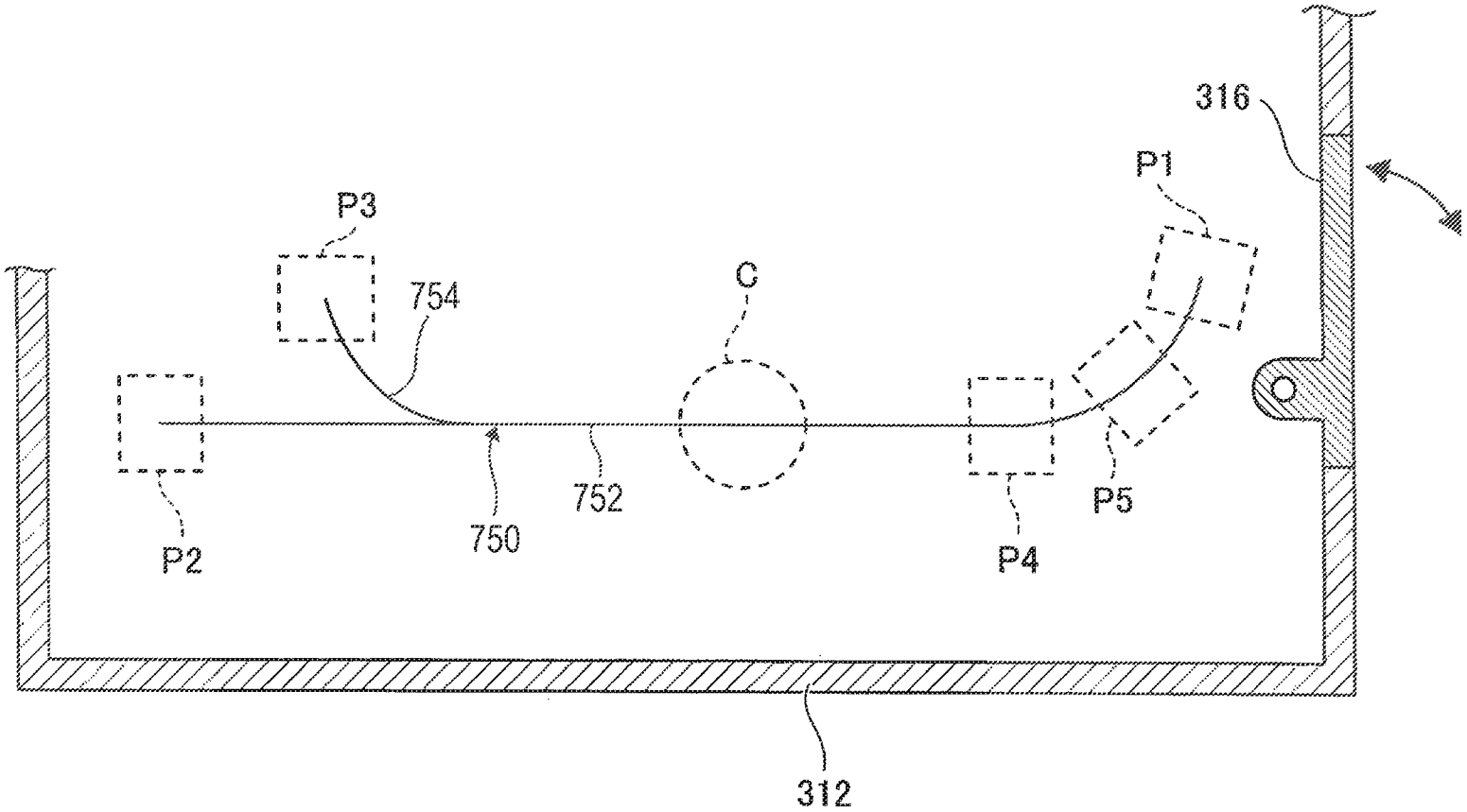
FIG. 19 is a schematic view illustrating a part of the binding apparatus illustrated in FIG. 15 when viewed from arrow A-A illustrated in FIG. 15.

The binding apparatus 400 further has a rail member 750 (for example, see FIG. 19). The rail member 750 is an example of a guide unit and guides movements of both of the pressing type binding unit 500 and the needle type binding unit 600. In addition, for convenience of illustration, the rail member 750 is not illustrated in FIG. 15. In addition, a detail of the rail member 750 will be described below.

Figure 16:
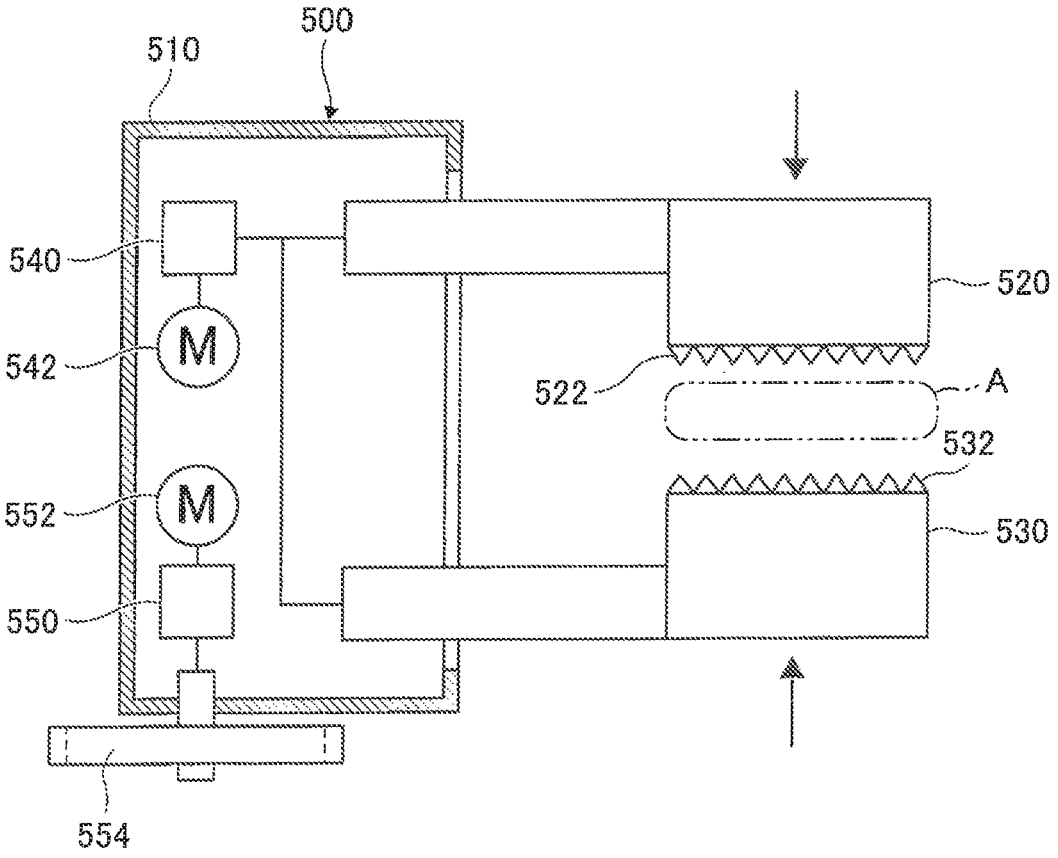
FIG. 16 is a schematic view for explaining a configuration of a pressing type binding unit of the binding apparatus illustrated in FIG. 15.

FIG. 16 is a schematic view for explaining a configuration of the pressing type binding unit 500. As illustrated in FIG. 16, the pressing type binding unit 500 has a unit main body 510, and an upper toothed part 520 is mounted to be movable relative to the unit main body 510. Multiple teeth 522 are formed on the upper toothed part 520. In addition, the upper toothed part 520 is disposed above a lower toothed part 530 to be described below so that the multiple teeth 522 are directed toward the lower toothed part 530.

The pressing type binding unit 500 further has the lower toothed part 530. The lower toothed part 530 is mounted to be movable relative to the unit main body 510 and has multiple teeth 532. In addition, the lower toothed part 530 is disposed below the upper toothed part 520 so that multiple teeth 532 are directed toward the upper toothed part 520. In addition, an interposition region A in which the paper sheets P are interposed is formed between the lower toothed part 530 and the upper toothed part 520.

The pressing type binding unit 500 further has a binding drive mechanism 540. The binding drive mechanism 540 transmits power from a binding drive source 542 to the upper toothed part 520 and the lower toothed part 530 to move the upper toothed part 520 and the lower toothed part 530 in a direction in which the upper toothed part 520 and the lower toothed part 530 approach or separate from each other.

In the pressing type binding unit 500 configured as described above, the bundle of paper sheets P is interposed between the upper toothed part 520 and the lower toothed part 530 within the interposition region A, and the upper toothed part 520 and the lower toothed part 530 press the bundle of paper sheets P. Further, as the upper toothed part 520 and the lower toothed part 530 press the paper sheets P, the paper sheets P adjacent to one another in the bundle of paper sheets P are attached to one another, so that the bundle of paper sheets P is integrally bound.

The pressing type binding unit 500 further has a movement drive mechanism 550. The movement drive mechanism 550 transmits power from a movement drive source 552 to a gear member 554 to rotate the gear member 554. A row of teeth of the gear member 554 meshes with a row of teeth 762 (see FIG. 20) formed on the rail member 750.

Figure 17:
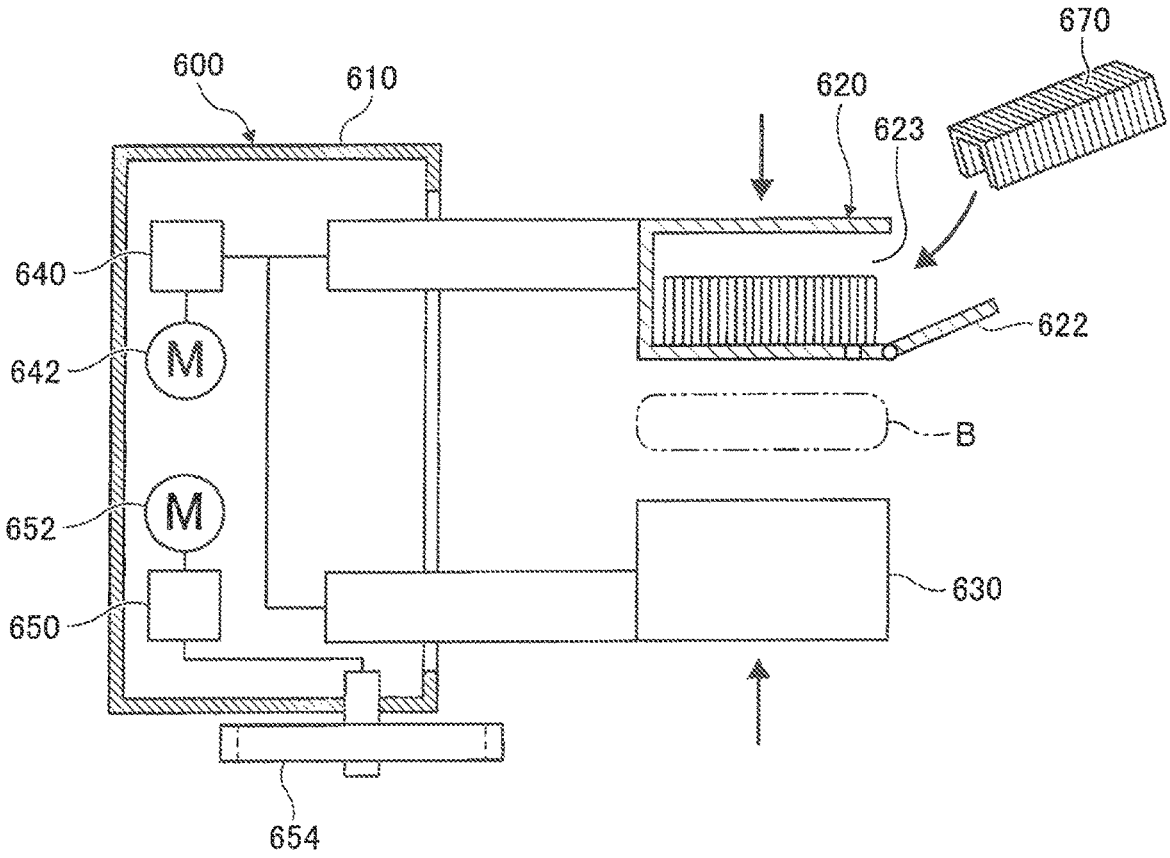
FIG. 17 is a schematic view for explaining a configuration of a needle type binding unit of the binding apparatus illustrated in FIG. 15.

FIG. 17 is a schematic view for explaining a configuration of the needle type binding unit 600. As illustrated in FIG. 17, the needle type binding unit 600 has a unit main body 610, and an upper moving unit 620 is mounted to be movable relative to the unit main body 610. An opening-closing unit 622 is mounted on the upper moving unit 620, and the needles 670 may be supplied into the upper moving unit 620 through an opening 624 formed by opening the opening-closing unit 622. In addition, the upper moving unit 620 is configured such that the number of remaining needles 670 may be checked from the opening-closing unit 622, for example, by opening the opening-closing unit 622.

The needle type binding unit 600 further has a lower moving unit 630. The lower moving unit 630 is mounted to be movable relative to the unit main body 610. In addition, an interposition region B into which the bundle of paper sheets P is interposed is formed between the lower moving unit 630 and the upper moving unit 620.

The needle type binding unit 600 further has a binding drive mechanism 640. The binding drive mechanism 640 transmits power from a binding drive source 642 to the upper moving unit 620 and the lower moving unit 630 to move the upper toothed part 520 and the lower toothed part 530 in a direction in which the upper toothed part 520 and the lower toothed part 530 approach each other.

In the needle type binding unit 600 configured as described above, the bundle of paper sheets P is interposed between the upper moving unit 620 and the lower moving unit 630 within the interposition region B, and when the paper sheets P are interposed, the bundle of paper sheets P is integrally bound by using the needle 670.

The needle type binding unit 600 further has a movement drive mechanism 650. The movement drive mechanism 650 transmits power from a movement drive source 652 to a gear member 654 to rotate the gear member 654. A row of teeth of the gear member 654 meshes with a row of teeth 764 (see FIG. 20) formed on the rail member 750.

In the image forming apparatus 10 configured as described above, the multiple paper sheets P may be bound by using the pressing type binding unit 500, and the multiple paper sheets P may be bound by using the needle type binding unit 600. In addition, the image forming apparatus 10 is configured such that for example, a manipulator may set any one of a mode (hereinafter, referred to as a needle type priority mode) in which the needle type binding unit 600 is used in preference to the pressing type binding unit 500, a mode (hereinafter, referred to as a pressing type priority mode) in which the pressing type binding unit 500 is used in preference to the needle type binding unit 600, and a mode (hereinafter, referred to as a pressing type dedicated mode) in which the needle type binding unit 600 is not used and only the pressing type binding unit 500 is used. Further, the image forming apparatus 10 is configured such that an initial mode is set to the needle type priority mode, and the mode may be changed from the needle type priority mode to the pressing type priority mode or the pressing type dedicated mode, for example, by a manipulation of the manipulator.

Figure 18:
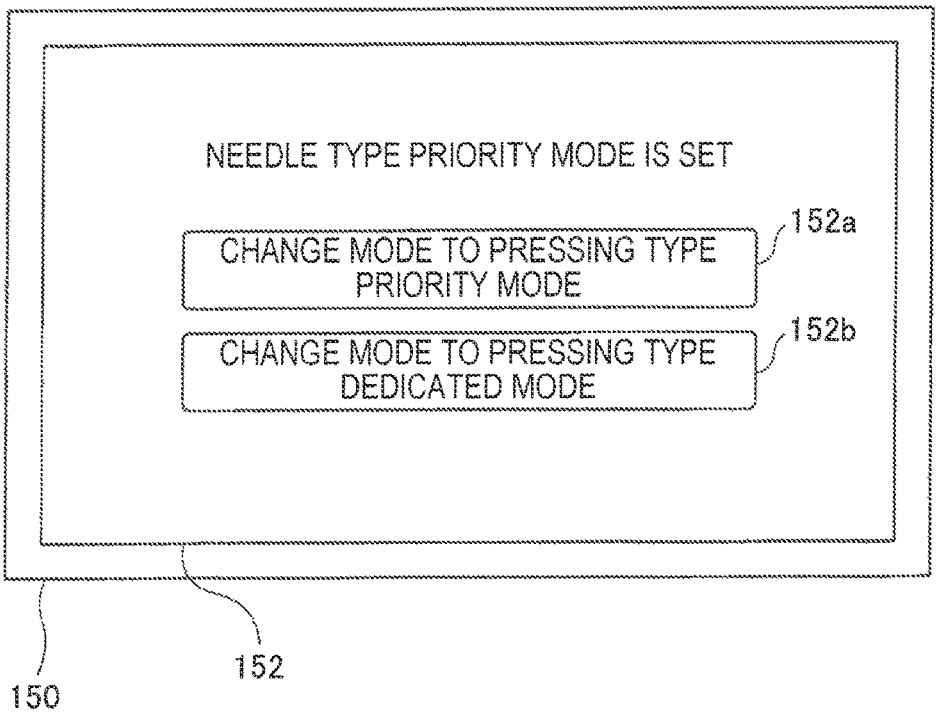
FIG. 18 is a view illustrating a mode selection screen displayed on an operation panel of the image forming apparatus illustrated in FIG. 14.

FIG. 18 illustrates a mode selection screen 152 which is one of the operation screens displayed on the operation panel 150. As illustrated in FIG. 18, a selection of the current mode such as, for example, "NEEDLE TYPE PRIORITY MODE IS SET" is displayed on the mode selection screen 152. In addition, mode change buttons 152*a* and 152*b* such as, for example, "CHANGE MODE TO PRESSING TYPE PRIORITY MODE" and "CHANGE MODE TO PRESSING TYPE DEDICATED MODE", which are manipulated to change the mode, are displayed on the mode selection screen 152.

FIG. 19 is a view illustrating a part of the configuration of the binding apparatus 400 when viewed from arrow A-A illustrated in FIG. 15. As illustrated in FIG. 19, the binding apparatus 400 has the rail member 750. The rail member 750 is an example of a guide unit and guides movements of both of the pressing type binding unit 500 and the needle type binding unit 600. In addition, the rail member 750 has a first guide unit 752, and a second guide unit 754 that branches off from the first guide unit 752 at the right side (upper side in FIG. 18).

The rail member 750 guides the movement of the pressing type binding unit 500 among a position P1, a position P5, a position P4, and a position P2 which are illustrated in FIG. 19. In addition, the rail member 750 guides the movement of the needle type binding unit 600 among the position P1, the position P5, the position P4, and the position P3 which are illustrated in FIG. 18.

The position P4 is an example of a standby position at which the pressing type binding unit 500 or the needle type binding unit 600 is on standby until the alignment of the paper sheets P is finished. For this reason, in the following description, the position P4 is referred to as the standby position P4. In addition, the position P5 is an example of a binding position at which the pressing type binding unit 500 or the needle type binding unit 600 binds the bundle of paper sheets P. For this reason, hereinafter, the position P5 is referred to as the binding position P5. In addition, details of the position P1, the position P2, and the position P3 will be described below.

In the binding apparatus 400 configured as described above, the pressing type binding unit 500 is on standby at the standby position P4, is moved to the binding position P5, and then binds the bundle of paper sheets P at the binding position P5. In addition, similarly, the needle type binding unit 600 is on standby at the standby position P4, is moved to the binding position P5, and then binds the bundle of paper sheets P at the binding position P5.

Here, in a case where the pressing type binding unit 500 is disposed at the position P1, the needle type binding unit 600 cannot be disposed at the position P5 because the pressing type binding unit 500 and the needle type binding unit 600 interfere with each other even when the needle type binding unit 600 is intended to be disposed at the binding position P5. For this reason, the pressing type binding unit 500 is required not to be disposed at the position P1 in order to bind the paper sheets P by using the needle type binding unit 600, and the pressing type binding unit 500 is required to be retracted from the position P1 to another position when the pressing type binding unit 500 is disposed at the position P1.

Similarly, in a case where the needle type binding unit 600 is disposed at the position P1, the pressing type binding unit 500 cannot be disposed at the position P5 because the pressing type binding unit 500 and the needle type binding unit 600 interfere with each other even when the pressing type binding unit 500 is intended to be disposed at the binding position P5. For this reason, the needle type binding unit 600 is required not to be disposed at the position P1 in order to bind the paper sheets P by using the pressing type binding unit 500, and the pressing type binding unit 500 is required to be retracted from the position P1 to another position when the needle type binding unit 600 is disposed at the position P1.

As illustrated in FIG. 19, the image forming apparatus 10 further has an opening-closing unit 316. The opening-closing unit 316 is mounted at a front side (right side in FIG. 19) of the post-processing unit main body 312. Further, in a case where the needle type binding unit 600 is disposed at the position P1, as the opening-closing unit 316 is opened, the needle type binding unit 600 may be visually checked from outside the post-processing unit main body 312, the needles 670 may be replenished to the needle type binding unit 600, and the number of remaining needles 670 in the needle type binding unit 600 may be checked.

Meanwhile, for example, when the needle type binding unit 600 is disposed at a location, such as the position P2, other than the position P1, the needles 670 cannot be replenished to the needle type binding unit 600, or the number of remaining needles 670 cannot be checked. The reason is that when the needle type binding unit 600 is not disposed at the position P2, a line of sight toward the needle type binding unit 600 is blocked and a space for replacing the needles 670 cannot be ensured even though the opening-closing unit 316 is opened, for example.

Figure 20:
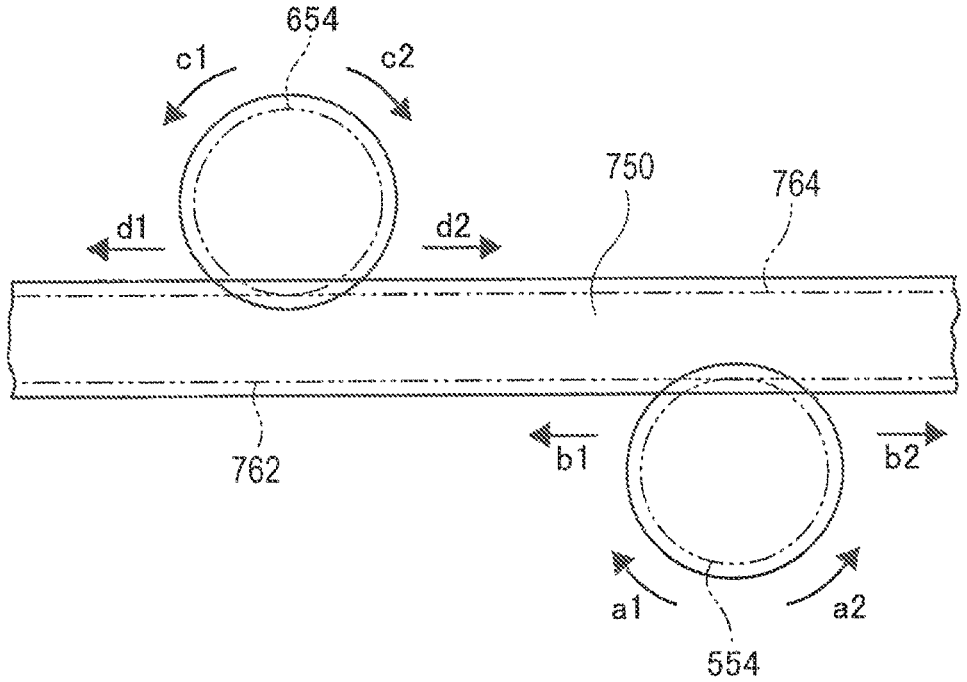
FIG. 20 is an enlarged view illustrating a part of a rail member of the binding apparatus illustrated in FIG. 15.

FIG. 20 is an enlarged view illustrating region C of the rail member 750 illustrated in FIG. 19. As illustrated in FIG. 20, the row of the teeth 762 is formed at one side of the rail member 750, and the gear member 554 of the pressing type binding unit 500 meshes with the row of the teeth 762. Further, as the gear member 554 rotates in a direction of arrow a1, the pressing type binding unit 500 is moved in a direction of arrow b1. In addition, as the gear member 554 rotates in a direction of arrow a2, the pressing type binding unit 500 is moved in a direction of arrow b2.

The row of the teeth 764 is formed at the other side of the rail member 750, and the gear member 654 of the needle type binding unit 600 meshes with the row of the teeth 764. Further, as the gear member 654 rotates in a direction of arrow c, the needle type binding unit 600 is moved in a direction of arrow d1. In addition, as the gear member 654 rotates in a direction of arrow c2, the needle type binding unit 600 is moved in a direction of arrow d2.

Figure 21:
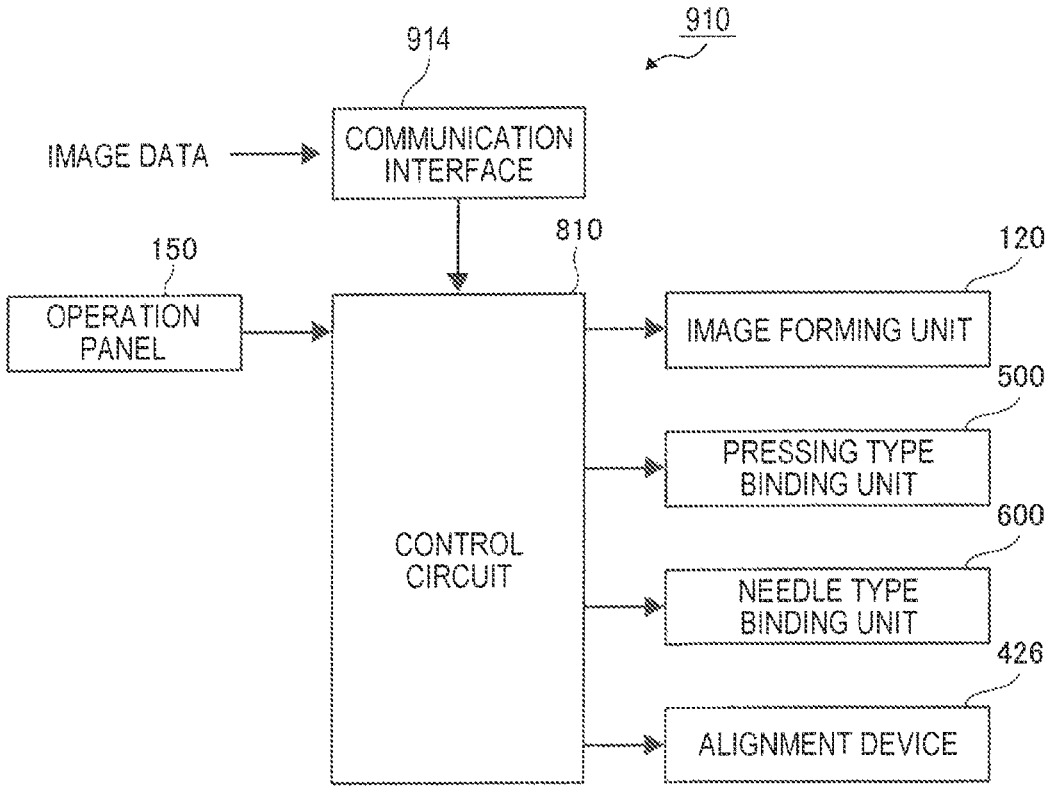
FIG. 21 is a block diagram illustrating a controller of the image forming apparatus illustrated in FIG. 14.

FIG. 21 is a block diagram illustrating a controller 910 of the image forming apparatus 10. As illustrated in FIG. 21, the controller 910 has a control circuit 810, and image data are inputted to the control circuit 810 through a communication interface 914. In addition, an output from the operation panel 150 is inputted to the control circuit 810. In addition, the image forming unit 120, the pressing type binding unit 500, the needle type binding unit 600, and the alignment device 426 are controlled based on the output from the control circuit 810.

Figure 22:
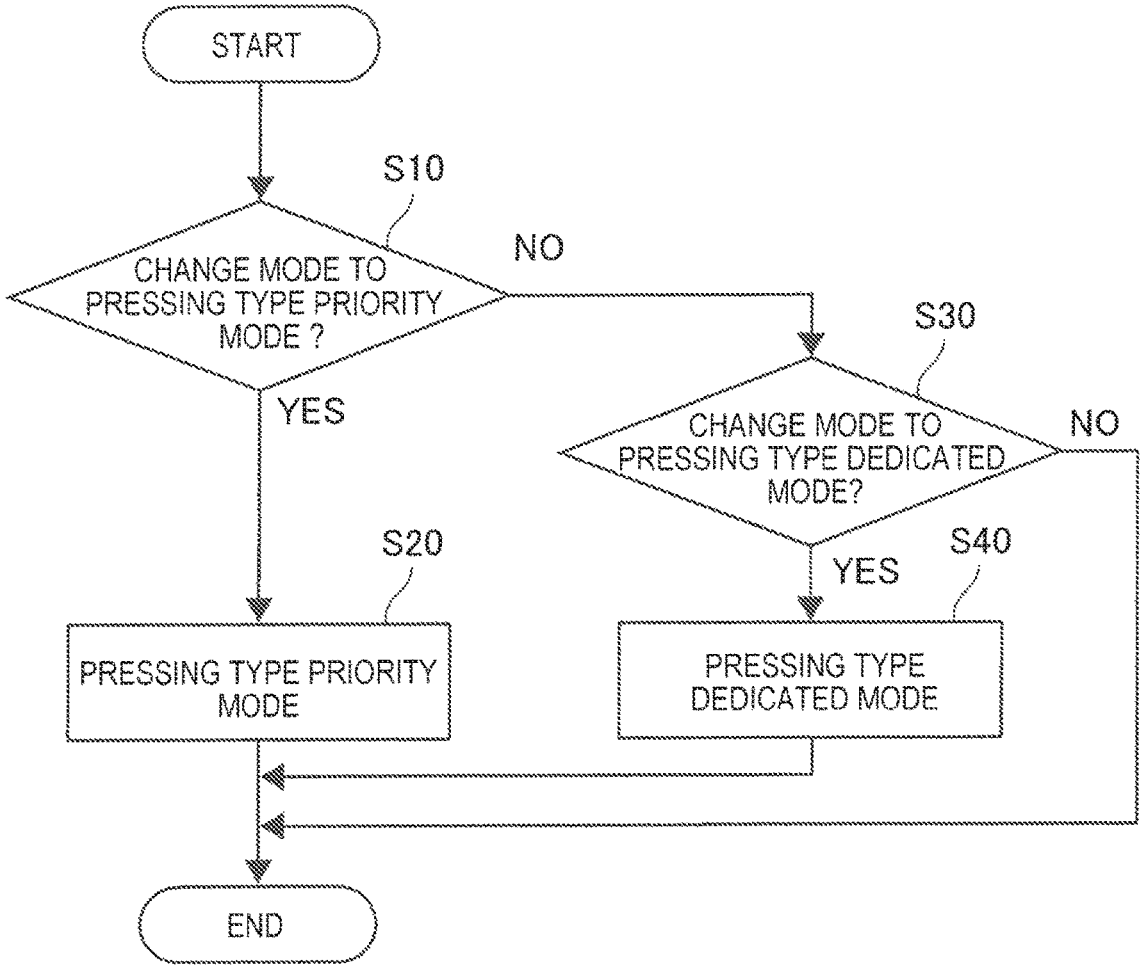
FIG. 22 is a flowchart for explaining a mode selection in the image forming apparatus illustrated in FIG. 14.

FIG. 22 is a flowchart for explaining a mode selection of the binding apparatus 400 in the image forming apparatus 10. In addition, as described above, in the image forming apparatus 10, the initial mode is set to the needle type priority mode. That is, the initial mode is set to the mode in which the needle type binding unit 600 is used in preference to the pressing type binding unit 500.

As illustrated in FIG. 22, in step S10 which is an initial step, the control circuit 810 determines whether there is an instruction to change the mode to the pressing type priority mode. That is, the control circuit 810 determines whether the mode change button 152*a* on the mode selection screen 152 is pushed within a predetermined time. Further, the process goes to step S20 when it is determined that there is the instruction to change the mode to the pressing type priority mode, and the process goes to step S30 when there is not the instruction to change the mode to the pressing type priority mode.

In step S20, the control circuit 810 switches the operation mode of the binding apparatus 400 to the pressing type priority mode and finishes the control.

In step S30, the control circuit 810 determines whether there is an instruction to change the mode to the pressing type dedicated mode. That is, the control circuit 810 determines whether the mode change button 152*b* on the mode selection screen 152 is pushed within a predetermined time. Further, the process goes to step S40 when it is determined that there is the instruction to change the mode to the pressing type dedicated mode, and the control ends when it is determined that there is not the instruction to change the mode to the pressing type dedicated mode.

In step S40, the control circuit 810 switches the operation mode of the binding apparatus 400 to the pressing type dedicated mode and subsequently finishes the control.

Figure 23:
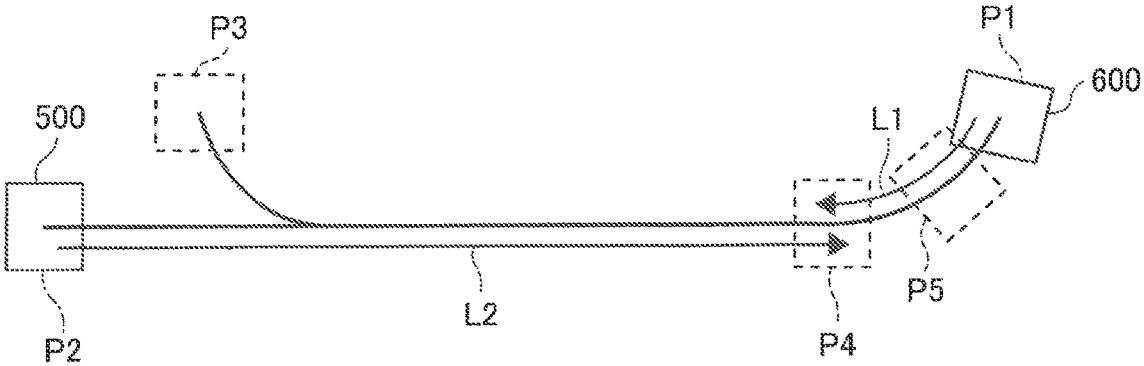
FIG. 23 is a view for explaining, in a needle type priority mode, arrangement of the pressing type binding unit and the needle type binding unit before the pressing type binding unit and the needle type binding unit start to operate and movements of the pressing type binding unit and the needle type binding unit.

Next, the needle type priority mode will be described. FIG. 23 is a view for explaining the arrangement of the pressing type binding unit 500 and the needle type binding unit 600 before the operation starts in the needle type priority mode. In the needle type priority mode, the position P1 is an example of a first start position, and the position P2 is an example of a second start position. For this reason, in the following description of the needle type priority mode, the position P1 is referred to as the first start position P1, and the position P2 is referred to as the second start position P2. In addition, in the needle type priority mode, the position P3 is an example of a retracted position. For this reason, in the following description of the needle type priority mode, the position P3 is referred to as the retracted position P3.

As illustrated in FIG. 23, in the binding apparatus 400, a path L1, which is required to move any one of the pressing type binding unit 500 and the needle type binding unit 600 from the first start position P1 to the standby position P4, becomes shorter than a path L2 which is required to move any one of the pressing type binding unit 500 and the needle type binding unit 600 from the second start position P2 to the standby position P4.

A movement speed of the pressing type binding unit 500 and a movement speed of the needle type binding unit 600 are constant and equal to each other. For this reason, in the binding apparatus 400, the time, which is required to move any one of the pressing type binding unit 500 and the needle type binding unit 600 from the start position P1 to the standby position P4, becomes shorter than the time required to move any one of the pressing type binding unit 500 and the needle type binding unit 600 from the start position P2 to the standby position P4.

As illustrated in FIG. 23, in the needle type priority mode, the needle type binding unit 600, which is used in preference to the pressing type binding unit 500, is disposed at the first start position P1 and the pressing type binding unit 500 is disposed at the second start position P2, before the operation starts.

Figure 24:
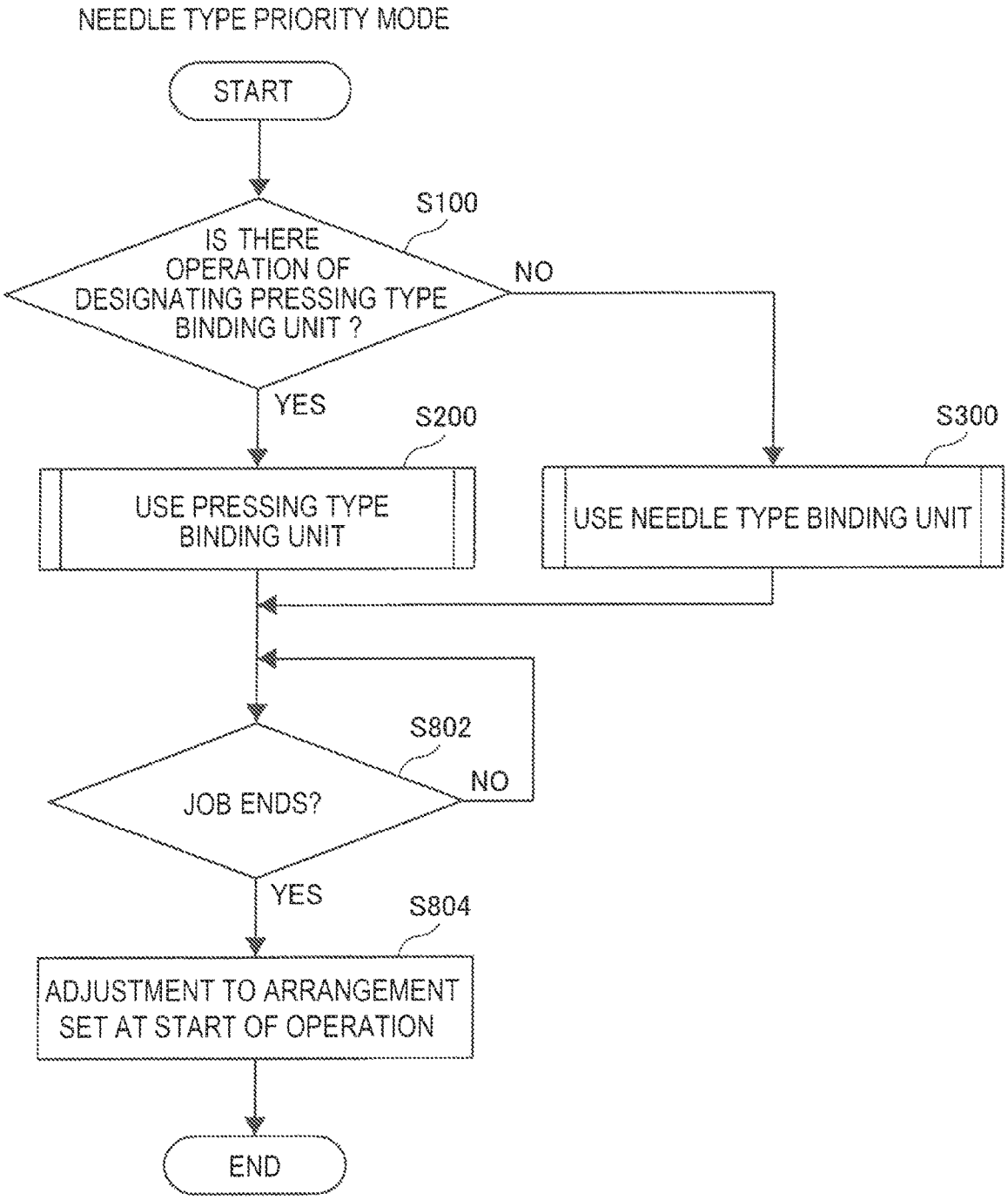
FIG. 24 is a flowchart for explaining designation of the binding unit in the needle type priority mode.

FIG. 24 is a first flowchart for explaining an operation of the binding apparatus 400 in the needle type priority mode. As illustrated in FIG. 24, upon starting a series of control, the control circuit 810 determines in step S100 whether there is an instruction to bind the bundle of paper sheets P by using the pressing type binding unit 500. More specifically, the control circuit 810 determines whether an operation of designating the pressing type binding unit 500 is performed within a predetermined time by using a binding unit switching screen (not illustrated, displayed on the operation panel 150).

The process goes to step S200 when the operation of designating the pressing type binding unit 500 is performed in step S100, and the process goes to step S300 when the operation of designating the pressing type binding unit 500 is not performed.

In step S200, the control circuit 810 controls the binding apparatus 400 to bind the paper sheets P by using the pressing type binding unit 500 of the binding apparatus 400. In addition, a detail of the operation of the control circuit 810 controlling the pressing type binding unit 500 to bind the paper sheets will be described below. The process goes to step S802 subsequent to step S200.

In step S300, the control circuit 810 controls the binding apparatus 400 and allows the needle type binding unit 600 of the binding apparatus 400 to bind the paper sheets. In this case, a detail of the operation of the control circuit 810 controlling the needle type binding unit 600 to bind the paper sheets will be described below.

After checking that the job ends in step S802, the control circuit 810, in step S804 which is a final step, adjusts the arrangement of the pressing type binding unit 500 and the needle type binding unit 600 to the arrangement before the operation starts in the needle type priority mode. That is, the control circuit 810 determines whether the pressing type binding unit 500 is disposed at the second start position P2 and the needle type binding unit 600 is disposed at the first start position, and when it is determined that the pressing type binding unit 500 is not disposed at the second start position P2 and the needle type binding unit 600 is not disposed at the first start position, the control circuit 810 moves the pressing type binding unit 500 and the needle type binding unit 600 so that the pressing type binding unit 500 is disposed at the second start position P2 and the needle type binding unit 600 is disposed at the first start position.

Figure 25:
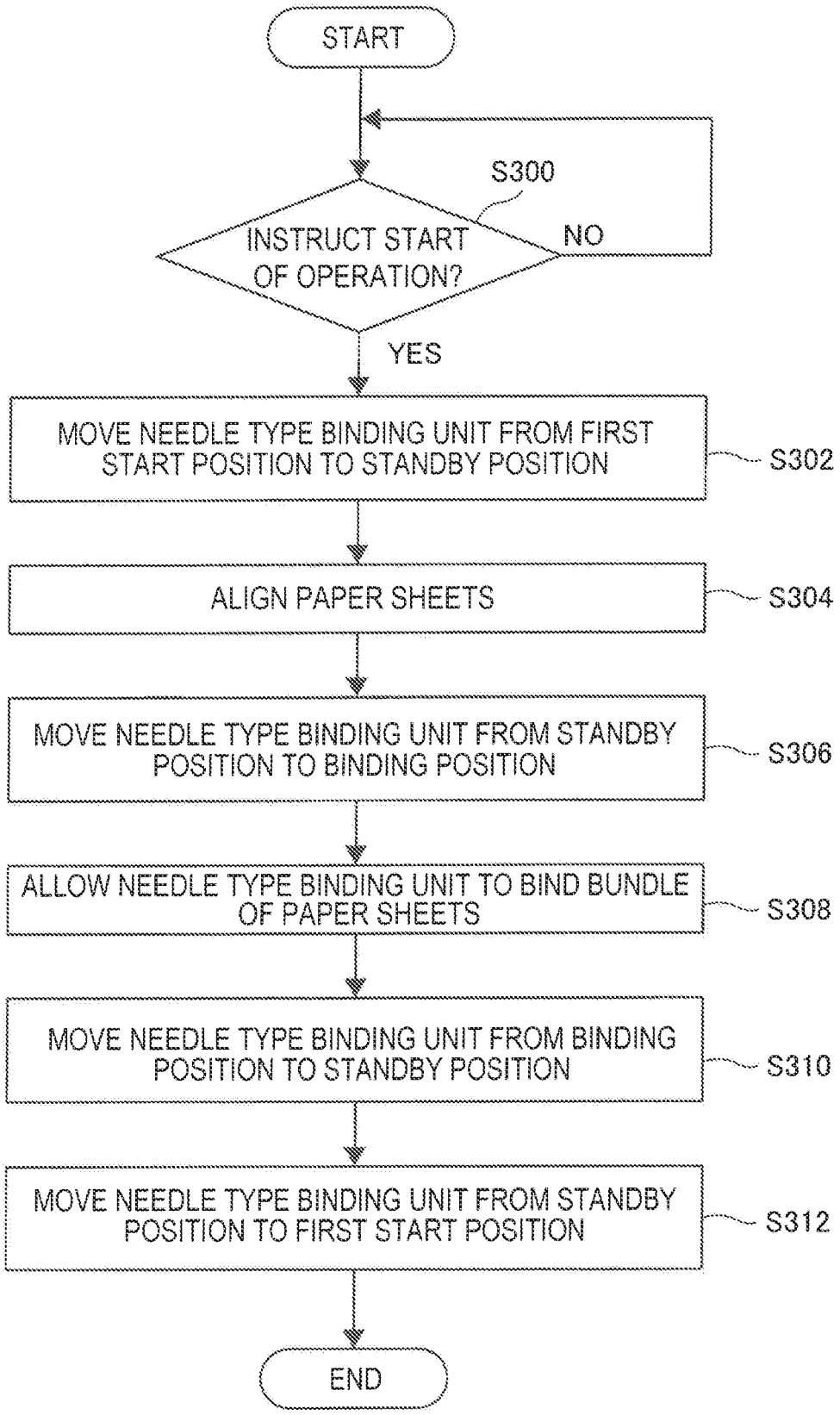
FIG. 25 is a flowchart for explaining an operation of the needle type binding unit when the needle type binding unit is used in the needle type priority mode.
Figure 26:
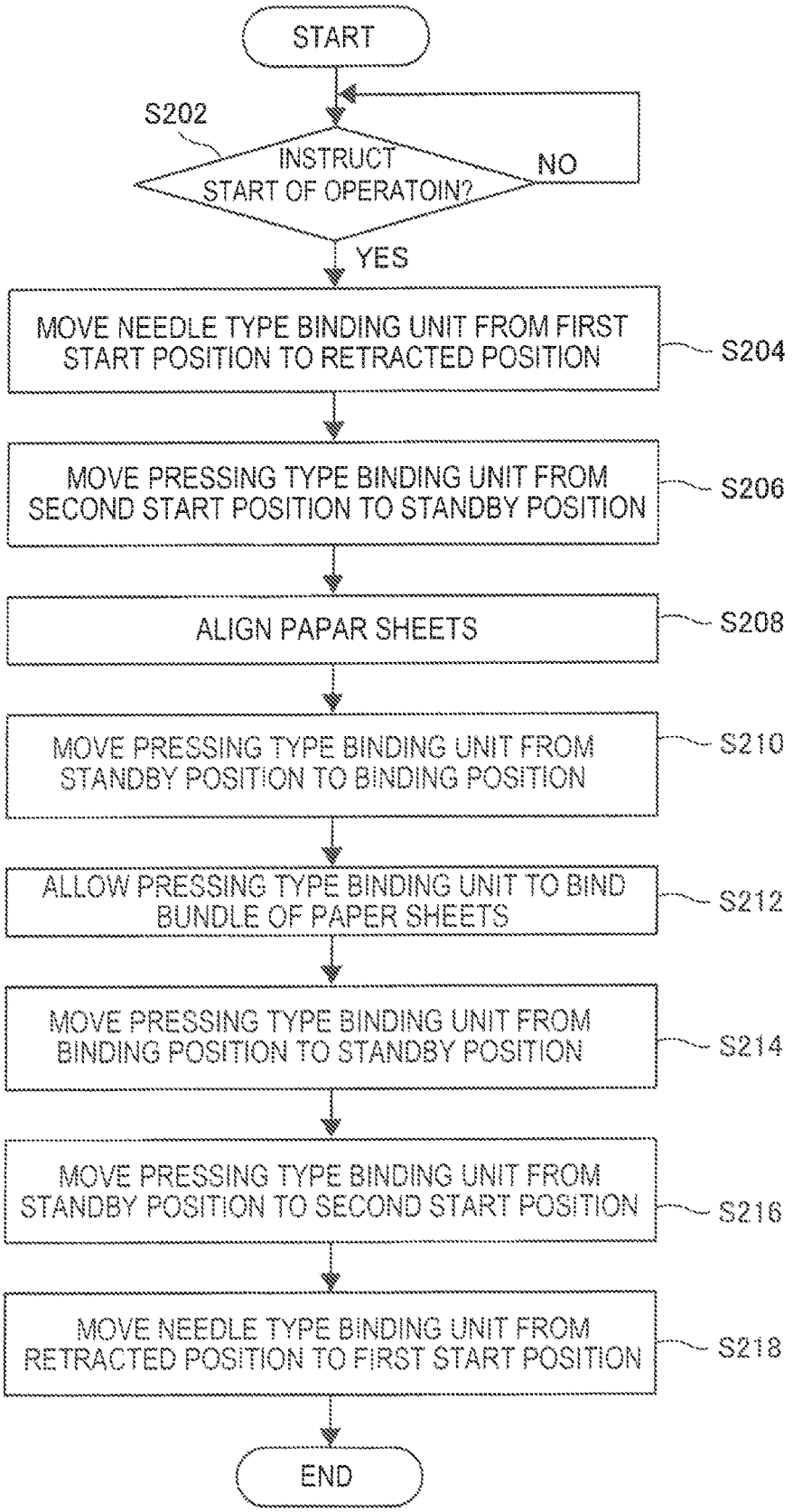
FIG. 26 is a flowchart for explaining an operation of the pressing type binding unit when the pressing type binding unit is used in the needle type priority mode.

FIG. 25 is a flowchart illustrating control in step S300 (control of binding the paper sheets P in the needle type priority mode by using the needle type binding unit 600), and FIG. 26 is a flowchart illustrating control in step S200 (control of binding the paper sheets P in the needle type priority mode by using the pressing type binding unit 500).

As illustrated in FIG. 25, to bind the paper sheets P in the needle type priority mode by using the needle type binding unit 600, an instruction to start an operation such as, for example, an operation of pushing a start button (not illustrated) is on standby in step S302, and in step S304, the control circuit 810 controls the needle type binding unit 600 to move the needle type binding unit 600 from the first start position to the standby position P4, and allows the needle type binding unit 600 to be on standby at the standby position P4 until the alignment of the bundle of paper sheets P is finished.

In step S304 which is a next step, the control circuit 810 controls the alignment device 426 to allow the alignment device 426 to align the bundle of paper sheets P loaded onto the loading unit 420.

In step S306 which is a next step, the control circuit 810 controls the needle type binding unit 600 to move the needle type binding unit 600 from the standby position P4 to the binding position P5.

In step S308 which is a next step, the control circuit 810 controls the needle type binding unit 600 to allow the needle type binding unit 600 to bind the bundle of paper sheets.

In step S310 which is a next step, the control circuit 810 controls the needle type binding unit 600 to move the needle type binding unit 600 from the binding position P5 to the standby position P4.

In step S312 which is a next step, the control circuit 810 controls the needle type binding unit 600 to move the needle type binding unit 600 to the first start position P1 and finish a series of control.

As illustrated in FIG. 26, to bind the paper sheets P in the needle type priority mode by using the pressing type binding unit 500, an instruction to start an operation such as, for example, an operation of pushing the start button (not illustrated) is on standby in step S202, and in step S204, the control circuit 810 controls the needle type binding unit 600 to move and retract the needle type binding unit 600 from the first start position P1 to the retracted position P3. Since the needle type binding unit 600 is retracted to the retracted position P3 as described above, the pressing type binding unit 500 and a movement trajectory of the pressing type binding unit 500 do not interfere with the needle type binding unit 600 when the pressing type binding unit 500 is moved to the binding position P5.

In step S206 which is a next step, the control circuit 810 controls the pressing type binding unit 500 to move the pressing type binding unit 500 from the second start position P2 to the standby position P4, and allows the pressing type binding unit 500 to be on standby at the standby position P4 until the alignment of the bundle of paper sheets P is finished.

In step S208 which is a next step, the control circuit 810 controls the alignment device 426 to allow the alignment device 426 to align the bundle of paper sheets P loaded onto the loading unit 420.

In step S210 which is a next step, the control circuit 810 controls the pressing type binding unit 500 to move the pressing type binding unit 500 from the standby position P4 to the binding position P5. In this case, the pressing type binding unit 500 does not interfere with the needle type binding unit 600, as described above.

In step S212 which is a next step, the control circuit 810 controls the pressing type binding unit 500 to allow the pressing type binding unit 500 to bind the bundle of paper sheets.

In step S214 which is a next step, the control circuit 810 controls the pressing type binding unit 500 to move the pressing type binding unit 500 from the binding position P5 to the standby position P4.

In step S216 which is a next step, the control circuit 810 controls the pressing type binding unit 500 to move the pressing type binding unit 500 from the standby position P4 to the second start position P2.

In step S218 which is a next step, to release the retraction of the needle type binding unit 600, the control circuit 810 controls the needle type binding unit 600 to move the needle type binding unit 600 from the retracted position P3 to the first start position P1 and finish a series of control.

Figure 27:
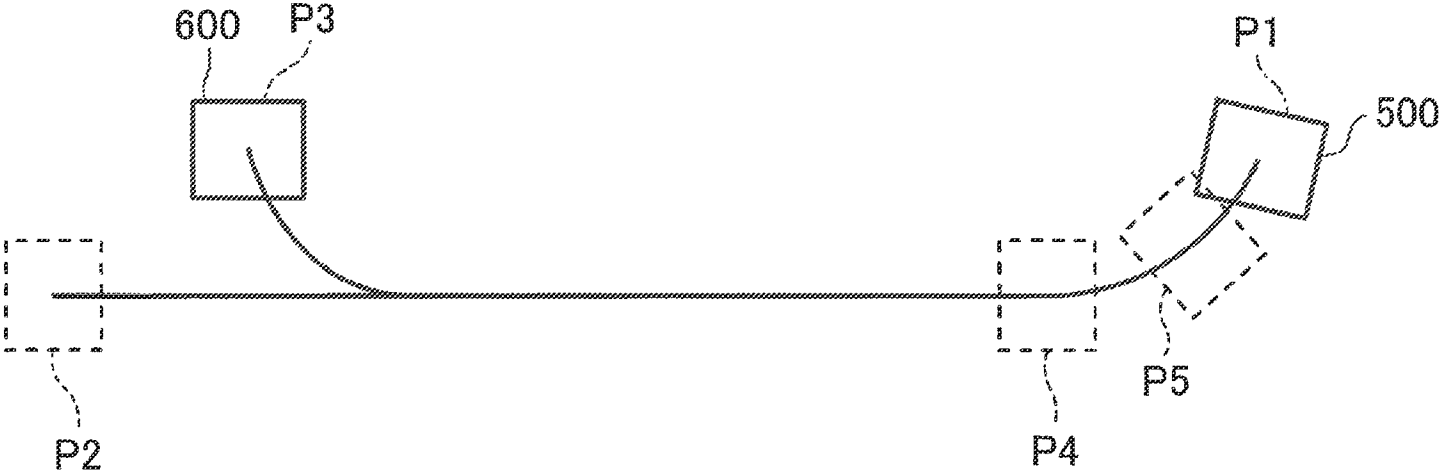
FIG. 27 is a view for explaining, in a pressing type priority mode, arrangement of the pressing type binding unit and the needle type binding unit before the pressing type binding unit and the needle type binding unit start to operate.

Next, the pressing type priority mode will be described. FIG. 27 is a view for explaining the arrangement of the pressing type binding unit 500 and the needle type binding unit 600 before the operation starts in the pressing type priority mode. In the needle type priority mode, the operation starts from a state in which the needle type binding unit 600 is disposed at the position P1 and the pressing type binding unit 500 is disposed at the position P2. In contrast, in the pressing type priority mode, as illustrated in FIG. 27, the operation starts in a state in which the pressing type binding unit 500 is disposed at the position P1 and the needle type binding unit 600 is disposed at the position P3.

In the pressing type priority mode, the position P1 is an example of the first start position, and the position P3 is an example of the second start position. In addition, as described below, the position P2 is an example of the retracted position. For this reason, in the following description of the pressing type priority mode, the position P1 is referred to as the first start position P1, the position P3 is referred to as the second start position P3, and the position P2 is referred to as the retracted position P2. In addition, similar to the needle type priority mode, even in the pressing type priority mode, the position P4 is an example of the standby position, and the position P5 is an example of the binding position, such that even in the following description of the pressing type priority mode, the position P4 is referred to as the standby position P4, and the position P5 is referred to as the binding position P5.

Figure 28:
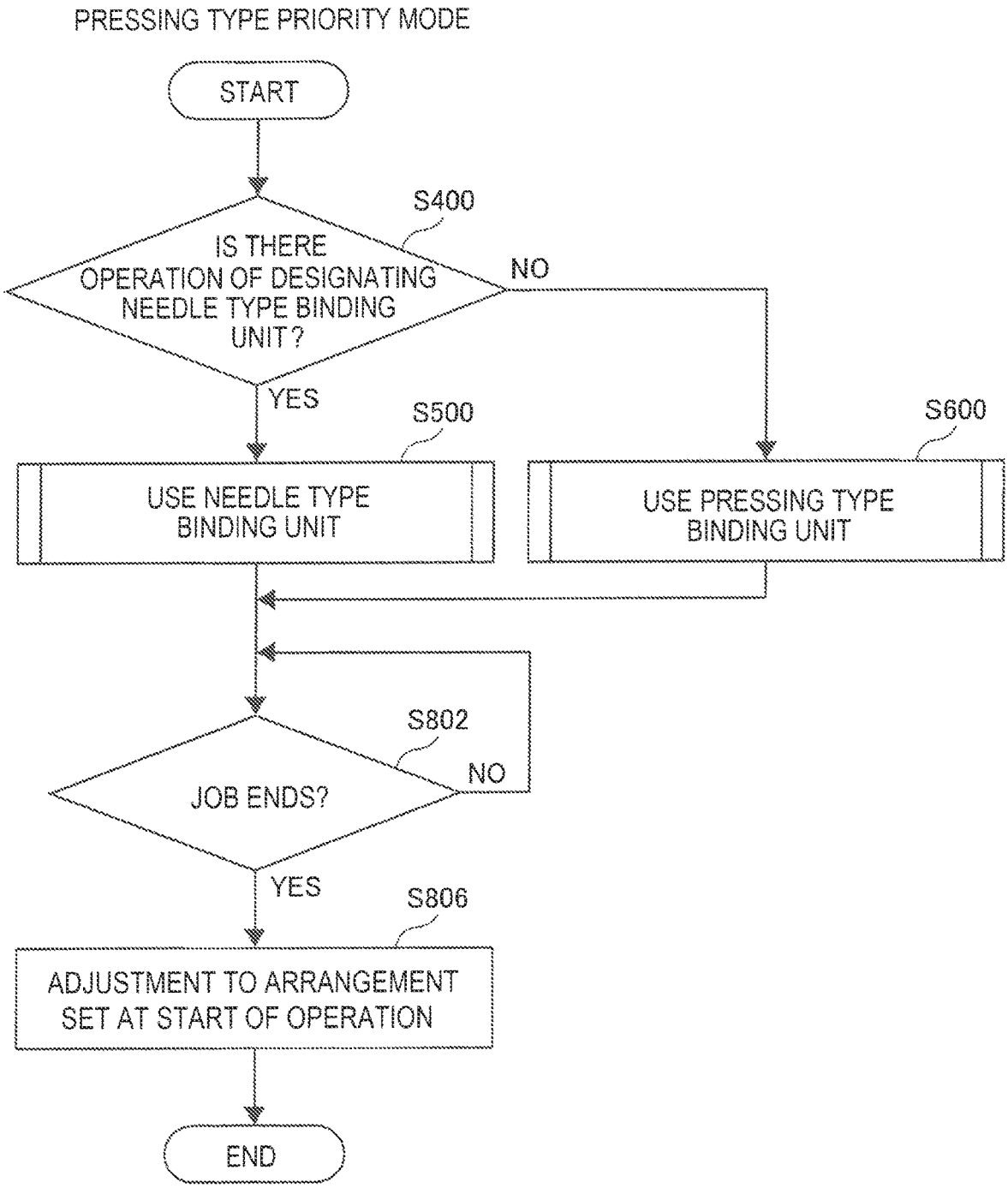
FIG. 28 is a flowchart for explaining designation of the binding unit in the pressing type priority mode.

FIG. 28 is a first flowchart for explaining the operation of the binding apparatus 400 in the pressing type priority mode. As illustrated in FIG. 28, upon starting a series of control, the control circuit 810 determines in step S400 whether there is an instruction to bind the bundle of paper sheets P by using the needle type binding unit 600. More specifically, the control circuit 810 determines whether an operation of designating the needle type binding unit 600 is performed within a predetermined time by using the binding unit switching screen (not illustrated, displayed on the operation panel 150).

The process goes to step S500 when the operation of designating the needle type binding unit 600 is performed in step S400, and the process goes to step S600 when the operation of designating the needle type binding unit 600 is not performed.

In step S500, the control circuit 810 controls the binding apparatus 400 to allow the needle type binding unit 600 to bind the paper sheets P. In addition, a detail of the operation of the control circuit 810 controlling the needle type binding unit 600 to bind the paper sheets will be described below. The process goes to step S802 subsequent to step S500.

In step S600, the control circuit 810 controls the binding apparatus 400 to allow the pressing type binding unit 500 of the binding apparatus 400 to bind the paper sheets. In this case, a detail of the operation of the control circuit 810 controlling the pressing type binding unit 500 to bind the paper sheets will be described below.

After checking that the job ends in step S802, the control circuit 810, in step S806 which is a final step, adjusts the arrangement of the pressing type binding unit 500 and the needle type binding unit 600 to the arrangement before the operation starts in the pressing type priority mode. That is, the control circuit 810 determines whether the needle type binding unit 600 is disposed at the second start position P3 and the pressing type binding unit 500 is disposed at the first start position, and when it is determined that the needle type binding unit 600 is not disposed at the second start position P3 and the pressing type binding unit 500 is not disposed at the first start position, the control circuit 810 moves the pressing type binding unit 500 and the needle type binding unit 600 so that the needle type binding unit 600 is disposed at the second start position P3 and the pressing type binding unit 500 is disposed at the first start position.

Figure 29:
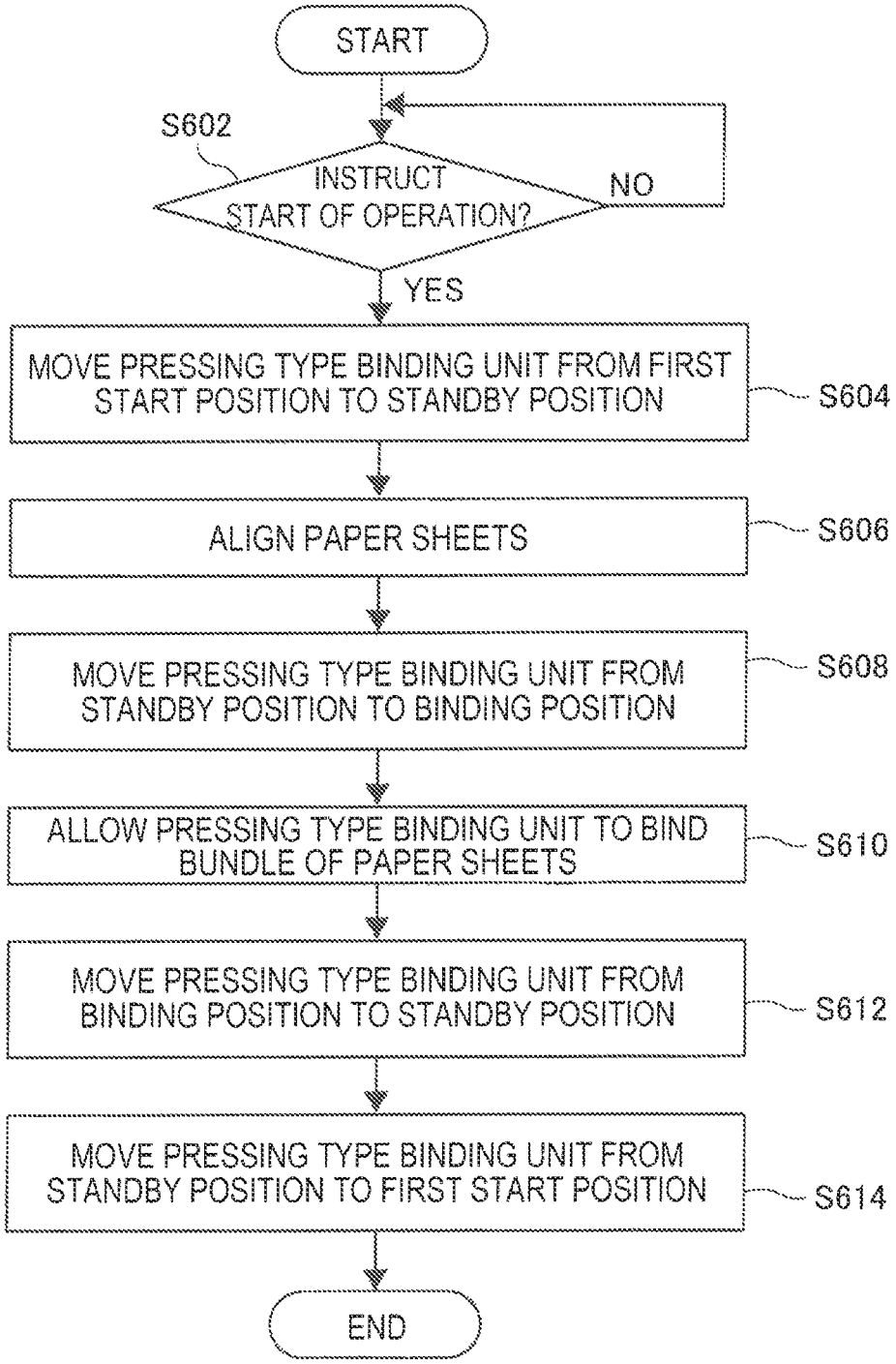
FIG. 29 is a view for explaining an operation of the pressing type binding unit when the pressing type binding unit is used in the pressing type priority mode.
Figure 30:
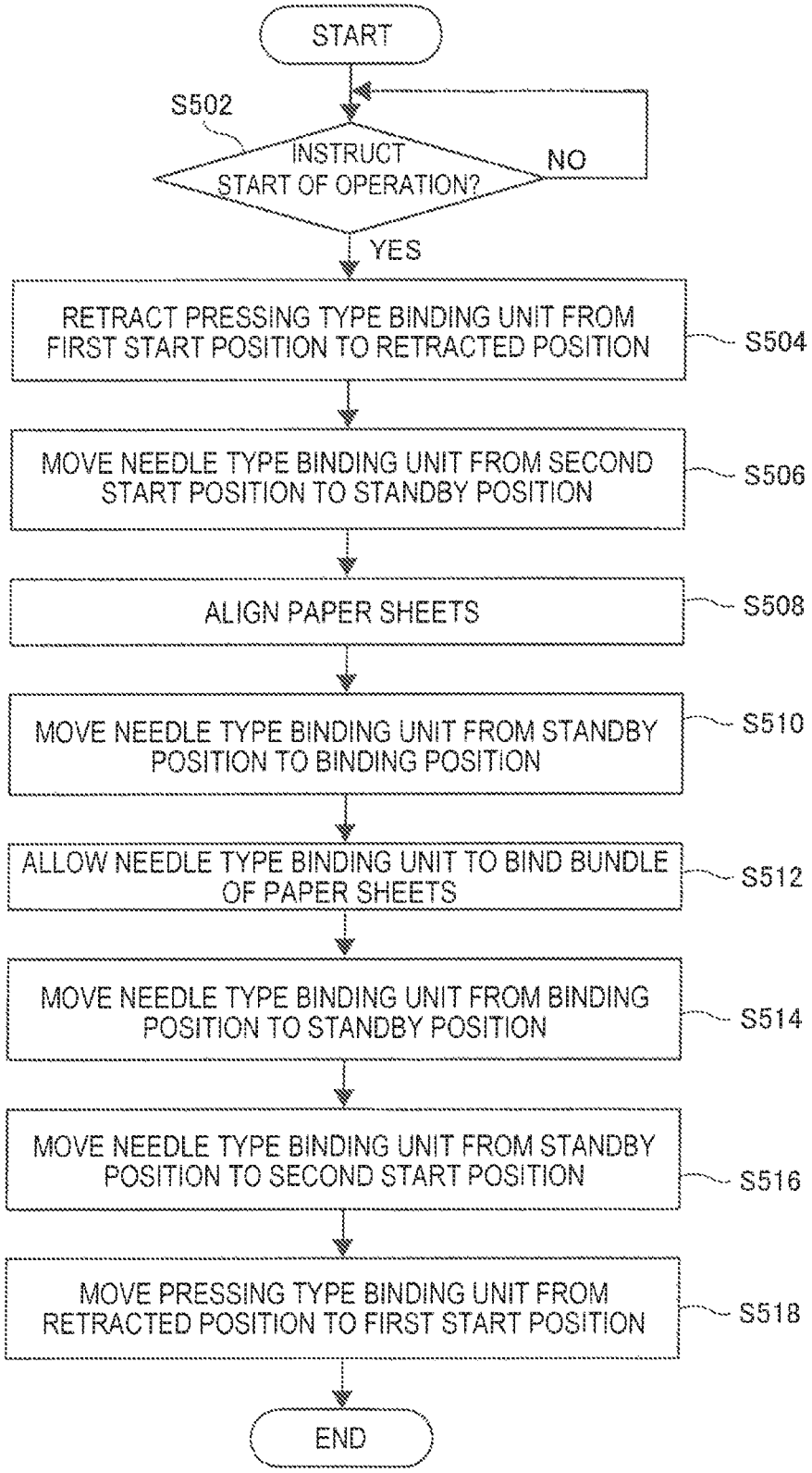
FIG. 30 is a flowchart for explaining an operation of the needle type binding unit when the needle type binding unit is used in the pressing type priority mode.

FIG. 29 is a flowchart illustrating control in step S600 (control of binding the paper sheets P in the pressing type priority mode by using the pressing type binding unit 500), and FIG. 30 is a flowchart illustrating control in step S500 (control of binding the paper sheets P in the pressing type priority mode by using the needle type binding unit 600).

As illustrated in FIG. 29, to bind the paper sheets P in the pressing type priority mode by using the pressing type binding unit 500, an instruction to start an operation such as, for example, the operation of pushing the start button (not illustrated) is on standby in step S602, and in step S604, the control circuit 810 controls the pressing type binding unit 500 to move the pressing type binding unit 500 from the first start position P1 to the standby position P4, and allows the pressing type binding unit 500 to be on standby at the standby position P4 until the alignment of the bundle of paper sheets P is finished.

In step S604 which is a next step, the control circuit 810 controls the alignment device 426 to align the bundle of paper sheets P loaded onto the loading unit 420.

In step S608 which is a next step, the control circuit 810 controls the pressing type binding unit 500 to move the pressing type binding unit 500 from the standby position P4 to the binding position P5.

In step S610 which is a next step, the control circuit 810 controls the pressing type binding unit 500 to allow the pressing type binding unit 500 to bind the bundle of paper sheets P.

In step S612 which is a next step, the control circuit 810 controls the pressing type binding unit 500 to move the pressing type binding unit 500 from the binding position P5 to the standby position P4.

In step S614 which is a next step, the control circuit 810 controls the pressing type binding unit 500 to move the pressing type binding unit 500 to the first start position P1 and finish a series of control.

As illustrated in FIG. 30, to bind the paper sheets P in the pressing type priority mode by using the needle type binding unit 600, an instruction to start an operation such as, for example, the operation of pushing the start button (not illustrated) is on standby in step S502, and in step S504, the control circuit 810 controls the pressing type binding unit 500 to move and retract the pressing type binding unit 500 from the first start position P1 to the retracted position P2. Since the pressing type binding unit 500 is retracted to the retracted position P2 as described above, the needle type binding unit 600 and a movement trajectory of the needle type binding unit 600 do not interfere with the pressing type binding unit 500 when the needle type binding unit 600 is moved to the binding position P5.

In step S506 which is a next step, the control circuit 810 controls the needle type binding unit 600 to move the needle type binding unit 600 from the second start position P3 to the standby position P4, and allows the needle type binding unit 600 to be on standby at the standby position P4 until the alignment of the bundle of paper sheets P is finished.

In step S508 which is a next step, the control circuit 810 controls the alignment device 426 to allow the alignment device 426 to align the bundle of paper sheets P loaded onto the loading unit 420.

In step S510 which is a next step, the control circuit 810 controls the needle type binding unit 600 to move the needle type binding unit 600 from the standby position P4 to the binding position P5. In this case, the needle type binding unit 600 does not interfere with the pressing type binding unit 500 as described above.

In step S512 which is a next step, the control circuit 810 controls the needle type binding unit 600 to allow the needle type binding unit 600 to bind the bundle of paper sheets P.

In step S514 which is a next step, the control circuit 810 controls the needle type binding unit 600 to move the needle type binding unit 600 from the binding position P5 to the standby position P4.

In step S516 which is a next step, the control circuit 810 controls the needle type binding unit 600 to move the needle type binding unit 600 from the standby position P4 to the second start position P3.

In step S518 which is a next step, to release the retraction of the pressing type binding unit 500, the control circuit 810 controls the pressing type binding unit 500 to move the pressing type binding unit 500 from the retracted position P2 to the first start position P1 and finish a series of control.

In the pressing type priority mode described above, before the operation starts, the needle type binding unit 600 is disposed at the second start position P3, but the needle type binding unit 600 is not disposed at the first start position P1. For this reason, the needles 670 cannot be supplied into the needle type binding unit 600 by opening the opening-closing unit 316 (see FIG. 19), and the number of remaining needles 670 in the needle type binding unit 600 cannot be checked by opening the opening-closing unit 316. For this reason, the image forming apparatus 10 is configured to be able to instruct the needle type binding unit 600 to move from the second start position P3 to the first start position P1 when the needles 670 are supplied into the needle type binding unit 600 or when the number of remaining needles 670 in the needle type binding unit 600 is checked.

Figure 31:
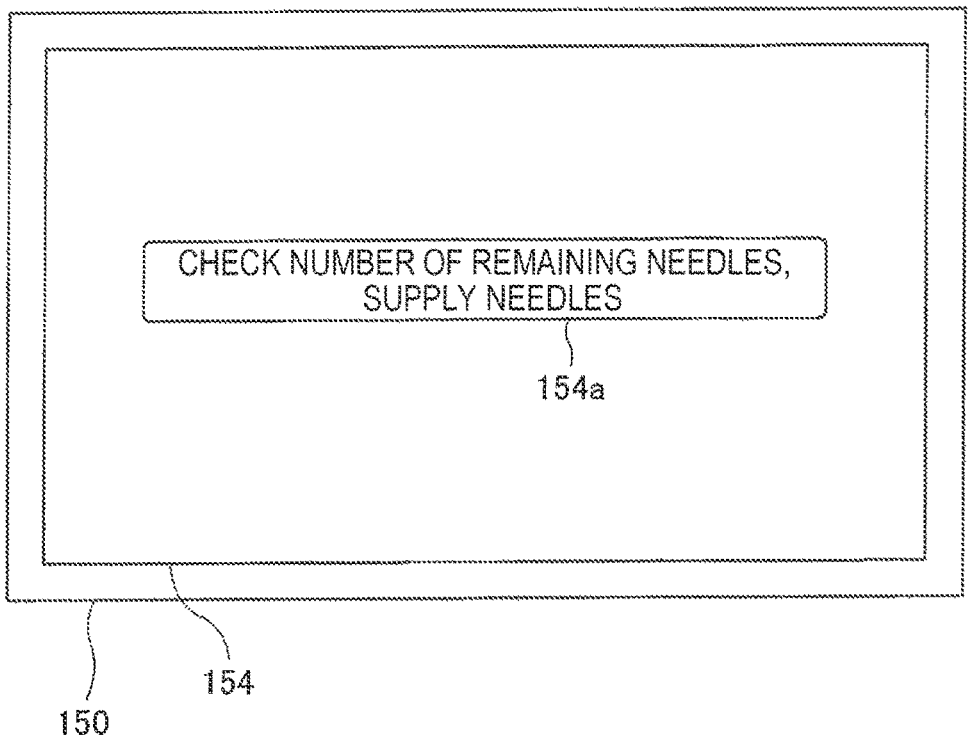
FIG. 31 is a view illustrating a needle supply screen displayed on the operation panel of the image forming apparatus illustrated in FIG. 14.

FIG. 31 illustrates a needle supply screen 154 which is one of the operation screens displayed on the operation panel 150. As illustrated in FIG. 31, an operation button 154*a* such as, for example, "CHECK NUMBER OF REMAINING NEEDLES" and "SUPPLY NEEDLES" is displayed on the needle supply screen 154. The operation button 154*a* is an example of an instruction unit, the needle type binding unit 600 is instructed to move from the second start position P3 to the first start position P1 by manipulating the operation button 154*a*.

When the needle type binding unit 600 is instructed to move, the control circuit 810 controls the pressing type binding unit 500 and the needle type binding unit 600 to retract the pressing type binding unit 500 to the retracted position P2 and then move the needle type binding unit 600 from the second start position P3 to the first start position P1.

Here, the needle supply screen 154 may be displayed only when the needle type binding unit 600 is disposed at a position other than the first start position P1, and the needle supply screen 154 is not displayed when the needle type binding unit 600 is positioned at the first start position P1. For this reason, the instruction to move the needle type binding unit 600 by the operation button 154*a* may be made only when the needle type binding unit 600 is disposed at the position other than the first start position, and the instruction is prohibited when the needle type binding unit 600 is positioned at the first start position.

Next, the pressing type dedicated mode will be described. In the pressing type dedicated mode, before the operation starts, the pressing type binding unit 500 is disposed at the position P1, the needle type binding unit 600 is disposed at the position P2, and the needle type binding unit 600 is not moved from the position P2. In addition, the position P3 is not used.

To bind the paper sheets P by the pressing type binding unit 500, the pressing type binding unit 500 moves from the position P1, which is an example of the start position, to the position P4 which is an example of the standby position, the pressing type binding unit 500 is on standby at the position P4 until the bundle of paper sheets P is aligned, and then the pressing type binding unit 500 moves to the position P5, which is an example of the binding position, and binds the bundle of paper sheets P. Further, after binding the paper sheets P, the pressing type binding unit 500 moves temporarily to the position P4 and then moves to the position P1. The operation of the pressing type binding unit 500 is implemented as the control circuit 810 controls the pressing type binding unit 500.

Figure 32:
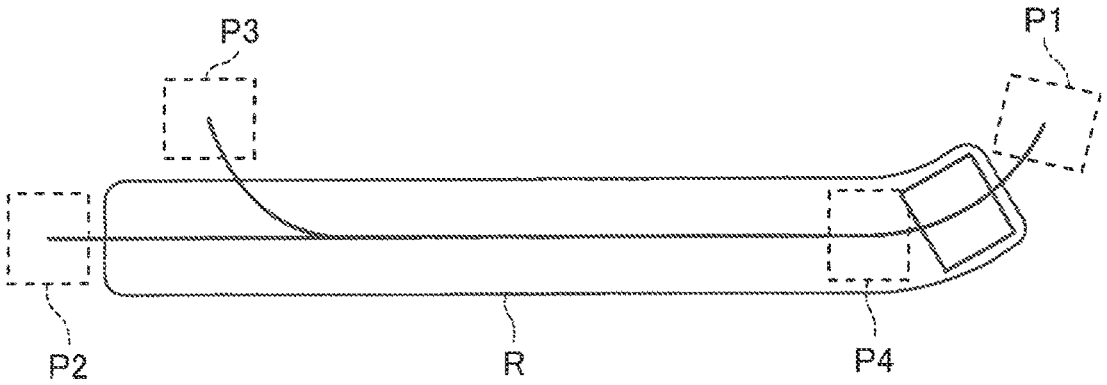
FIG. 32 is a view for explaining a limitation to positions at which the pressing type binding unit and the needle type binding unit bind paper sheets in a modified example of the binding apparatus.

FIG. 32 is a view for explaining the arrangement of the pressing type binding unit 500 and the needle type binding unit 600 in the binding apparatus 400 in a modified example of the image forming apparatus 10. In the binding apparatus 400 in the previous exemplary embodiment, the position P5 is the binding position, and one of the pressing type binding unit 500 and the needle type binding unit 600 retracts from the position P1 so as not to interfere with the other of the pressing type binding unit 500 and the needle type binding unit 600 which binds the paper sheets P at the position P5.

In contrast, in the modified example, a position at which one of the pressing type binding unit 500 and the needle type binding unit 600 binds the paper sheets P is limited to a position at which the one of the pressing type binding unit 500 and the needle type binding unit 600 does not interfere with the other of the pressing type binding unit 500 and the needle type binding unit 600 which is stopped at the position P1 and does not interfere with the other of the pressing type binding unit 500 and the needle type binding unit 600 which is stopped at the position P2. Specifically, the position at which the pressing type binding unit 500 and the needle type binding unit 600 bind the paper sheets P is limited within a range R illustrated in FIG. 32.

In the image forming apparatus 10 described above, the example is described in which the pressing type binding unit 500, which does not use the binding member (needle 670), is used as the first binding unit and the needle type binding unit 600, which uses the binding member (needle 670), is used as the second binding unit, but both of the first binding unit and the second binding unit may use the binding member, and for example, the first binding unit and the second binding unit may use different types of binding members.

In the image forming apparatus 10 described above, the pressing type binding unit 500 and the needle type binding unit 600 are controlled to move from the first start position and the second start position to the standby position P4, move from the standby position P4 to the binding position P5, and then bind the paper sheets at the binding position P5, but the pressing type binding unit 500 and the needle type binding unit 600 may be controlled to move to the binding position P5 without moving to the standby position P4, and then bind the paper sheets at the binding position P5.

In this case, the binding apparatus 400 is configured to have the pressing type binding unit 500 which moves to the binding position P5 from a stopped state at one of the first start position and the second start position and binds the paper sheets, the needle type binding unit 600 which moves to the binding position P5 from a stopped state at the other of the first start position and the second start position, and binds the paper sheets, and the control circuit 810 which sets one of the pressing type binding unit 500 and the needle type binding unit 600 so that the one of the pressing type binding unit 500 and the needle type binding unit 600 is used in preference to the other of the pressing type binding unit 500 and the needle type binding unit 600, in which the time, which is required to move any one of the pressing type binding unit 500 and the needle type binding unit 600 to the binding position P5, is shorter at the first start position than at the second start position, and the one of the pressing type binding unit 500 and the needle type binding unit 600, which is set to be used in preference to the other of the pressing type binding unit 500 and the needle type binding unit 600, is disposed at the first start position before the operation starts.

In the image forming apparatus 10 described above, the pressing type binding unit 500 and the needle type binding unit 600 may be configured to bind the paper sheets even at other binding positions (not illustrated) different from the binding position P5. Further, even in the image forming apparatus 10 configured as described above, before the operation starts, the pressing type binding unit 500 and the needle type binding unit 600 may be disposed at the position identical to the position in the case where the pressing type binding unit 500 and the needle type binding unit 600 is configured to bind the paper sheets only at the binding position P5, and the pressing type binding unit 500 and the needle type binding unit 600 may be controlled to be moved similar to the case where the pressing type binding unit 500 and the needle type binding unit 600 may be configured to bind the paper sheets only at the position P5.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding apparatus comprising:

a first toothed part including a plurality of teeth arranged in one direction; and a second toothed part that includes a plurality of teeth arranged in the one direction and is configured to mesh with the first toothed part and to press a bundle of sheets, wherein at least one first groove is formed between adjacent teeth of the first toothed part, the first groove has cross-sectional areas at central and end portions in a direction orthogonal to the one direction and a direction in which the first and second toothed parts mesh with each other, the one direction and the orthogonal direction are normal to the cross-sectional areas, and the cross-sectional area at the end portion is larger than the cross-sectional area at the central portion.

2. The binding apparatus according to claim 1, wherein at least one second groove is formed between adjacent teeth of the second toothed part, the second groove has cross-sectional areas at central and end portions in the orthogonal direction, the orthogonal direction is normal to the cross-sectional areas, and the cross-sectional area at the end portion is larger than the cross-sectional area at the central portion.

3. The binding apparatus according to claim 1, wherein the first groove has widths in the one direction at outer and inner sides of the first toothed part in the orthogonal direction, and the width on the outer side is larger than the width on the inner side.

4. The binding apparatus according to claim 1, wherein the at least one first groove includes two first grooves that are formed to sandwich one of the first teeth and have a symmetrical shape with respect to a center of the one of the first teeth in the orthogonal direction.

5. The binding apparatus according to claim 1, wherein the first groove has a shape being oblique to the first teeth and varying in the orthogonal direction.

6. The binding apparatus according to claim 1, wherein the first groove has widths in the meshing direction at outer and inner sides of the first toothed part in the orthogonal direction, and the width on the outer side is larger than the width on the inner side.

7. The binding apparatus according to claim 1, wherein the first groove has widths in the one direction at outer and inner sides of the first toothed part in the orthogonal direction, wherein the width on the outer side is larger than the width on the inner side, and the first groove has widths in the meshing direction at outer and inner sides of the first toothed part in the orthogonal direction, wherein the width on the outer side is larger than the width on the inner side.

* * * * *